US007877040B2

(12) United States Patent
Ueda

(10) Patent No.: US 7,877,040 B2
(45) Date of Patent: Jan. 25, 2011

(54) IMAGE RECORDING APPARATUS

(75) Inventor: Kiyoshi Ueda, Anjo (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 641 days.

(21) Appl. No.: 11/535,557

(22) Filed: Sep. 27, 2006

(65) Prior Publication Data

US 2007/0071498 A1 Mar. 29, 2007

(30) Foreign Application Priority Data

Sep. 28, 2005 (JP) ..... 2005-281247

(51) Int. Cl.
*G03G 21/16* (2006.01)

(52) U.S. Cl. ..... 399/111; 399/302

(58) Field of Classification Search ..... 347/16, 347/108

See application file for complete search history.

(56) References Cited

U.S. PATENT DOCUMENTS

| | | | | |
|---|---|---|---|---|
| 4,519,723 | A | 5/1985 | Kusmierz | |
| 4,688,692 | A | 8/1987 | Humbs et al. | |
| 5,706,700 | A | 1/1998 | Takagi et al. | |
| 6,705,693 | B2 * | 3/2004 | Lim et al. | 347/8 |
| 2005/0195242 | A1 | 9/2005 | Samoto et al. | |

FOREIGN PATENT DOCUMENTS

| | | | |
|---|---|---|---|
| EP | 0089633 | A1 | 9/1983 |
| EP | 0139245 | A2 | 2/1985 |
| EP | 0156019 | A2 | 10/1985 |
| EP | 0351854 | A2 * | 1/1990 |
| EP | 1574349 | A1 | 9/2005 |
| GB | 2133350 | A | 12/1983 |
| JP | S60-217189 | A | 10/1985 |

(Continued)

OTHER PUBLICATIONS

European Patent Office; Communication pursuant to Article 94(3) EPC in European Patent Application No. 06 020 416.1-1251 (counterpart to the above-captioned U.S. Patent Application) mailed Feb. 17, 2009.

(Continued)

*Primary Examiner*—Stephen D Meier
*Assistant Examiner*—Alexander C Witkowski
(74) *Attorney, Agent, or Firm*—Baker Botts L.L.P.

(57) ABSTRACT

A supporting apparatus for supporting a movable member such that the movable member is movable along a predetermined path. The apparatus includes a main frame which defines a reference plane parallel to the predetermined path; at least one base member which is supported by the main frame and which supports the movable member such that the movable member is movable on the at least one base member along the predetermined path; at least one positioning device which positions the at least one base member relative to the main frame in at least one first direction parallel to the reference plane and a second direction perpendicular to the reference plane, such that the at least one base member is permitted to be displaced relative to the main frame in a third direction opposite to the second direction; and at least one biasing device which biases the at least one base member toward the main frame in at least the second direction.

17 Claims, 13 Drawing Sheets

FOREIGN PATENT DOCUMENTS

| | | | | |
|---|---|---|---|---|
| JP | 62071679 | A | * | 4/1987 |
| JP | 1987071679 | A | | 4/1987 |
| JP | S62-071679 | A | | 4/1987 |
| JP | 1991031565 | U | | 3/1991 |
| JP | H05-036116 | U | | 5/1993 |
| JP | H07-016016 | U | | 3/1995 |
| JP | 1996074714 | A | | 3/1996 |
| JP | 2005-246907 | A | | 9/2005 |

OTHER PUBLICATIONS

European Patent Office, European Search Report Application No. EP 06020416, dated Apr. 13, 2007.

Japan Patent Office, Notification of Reason for Refusal, for Patent Application No. JP2005-281247 (counterpart to above-captioned patent application), mailed Aug. 17, 2010.

* cited by examiner

PRIOR ART

IMAGE RECORDING APPARATUS

The present application is based on Japanese Patent Application No. 2005-281247 filed on Sep. 28, 2005, the contents of which are incorporated herein by reference.

BACKGROUND OF THE INVENTION

1. Field of the Invention

The present invention relates to an image recording apparatus and, in particular, to a construction of a frame assembly as a supporting apparatus.

2. Discussion of Related Art

FIG. 13 illustratively shows an image recording portion of a conventional ink-jet recording device. The conventional ink-jet recording device includes a platen 1 on which a recording sheet is placed; and an ink-jet recording head 2 that is reciprocated, along the platen 1, in a main scanning direction (i.e., a direction perpendicular to the drawing of FIG. 13) while ejecting droplets of ink toward the recording sheet so as to record a desired image thereon. Therefore, recording a clear image needs to position accurately the platen 1 and the recording head 2 relative to each other and maintain the accurate relative-positional relationship between the two elements 1, 2 during an image recording operation. To this end, the conventional ink-jet recording device employs a frame assembly 3 as a supporting device that supports the platen 1 and the recording head 2.

The frame assembly 3 includes a main frame 4, and two slide-base members 5, 6 that are supported by the main frame 4. The main frame 4 has a generally U-shaped transverse cross section, and extends in the direction perpendicular to the drawing of FIG. 13. The main frame 4 is provided with two crossing members 7 that cooperate with each other to increase a rigidity of the main frame 4. The platen 1 is fixed to the main frame 4. One slide-base member 5 is fixed to respective one end portions of the two crossing members 7; and the other slide-base member 6 is fixed to the respective other end portions of the two crossing members 7. Each of the two slide-base members 5, 6 also has a generally U-shaped transverse cross section. The recording head 2 bridges the two slide-base members 5, 6 such that the head 2 is movable in the direction perpendicular to the drawing of FIG. 13.

To position accurately the recording head 2 relative to the platen 1 when the head 2 is moved along the platen 1, it is needed to fix accurately the two slide-base members 5, 6 to the main frame 4. To this end, in a conventional method, the frame assembly 3 is assembled such that the two slide-base members 5, 6 are accurately positioned relative to the main frame 4, before the platen 1 and the recording head 2 are assembled with the frame assembly 3. More specifically explained, in the conventional method, the main frame 4 is provided with one or more engaging portions, and each of the two slide-base members 5, 6 is provided with one or more engageable portions. In a state in which the engaging and engageable portions are engaged with each other, the engaging portions are caulked to position accurately the two slide-base members 5, 6 relative to the main frame 4. The image recording portion is assembled in such a manner that the platen 1 and the recording head 2 are assembled with the pre-assembled frame assembly 3.

SUMMARY OF THE INVENTION

However, in the above-explained conventional method, the two slide-base members 5, 6 are substantially permanently fixed to the main frame 4, i.e., cannot be easily disassembled from the same 4. Therefore, the assembling of the image recording portion suffers from the disadvantage that it is difficult to attach the platen 1 and/or the recording head 2 to the frame assembly 3. In addition, recently, there is a tendency that the ink-jet recording device is downsized and accordingly the frame assembly 3 thereof is also downsized. Thus, it is more and more difficult to attach the platen 1 and/or the recording head 2 to the frame assembly 3.

The above-indicated problem seems to be solved by attaching, with screws, the two slide-base members 5, 6 to the main frame 4, such that the slide-base members 5, 6 can be detached from the main frame 4, with a screw driver. In this case, after the platen 1 is assembled with the main frame 4, the two slide-base members 5, 6 are fastened to the main frame 4 and then the ink-jet recording head 2 is attached to the slide-base members 5, 6. In the image recording portion assembled in this manner, however, the main frame 4 or the slide-base members 5, 6 may be locally deformed by the fastening of the screws, so that the slide-base members 5, 6 may not be accurately positioned relative to the main frame 4. In addition, for the purpose of fastening the slide-base members 5, 6 to the main frame 4, it is needed to employ fastening nuts to engage the screws and provide additional spaces in which those nuts are disposed. This makes it difficult to downsize the image recording device.

Each of Patent Document 1 (Japanese Utility Model Application Publication No. 3-31565) and Patent Document 2 (Japanese Patent Application Publication No. 62-71679) discloses a frame structure for use in an image recording device or a multi-function device. In particular, Patent Document 1 discloses a frame structure including a positioning means and a biasing means.

In the above-described technical background, the present invention has been developed. It is therefore an object of the present invention to solve at least one of the above-indicated problems. It is another object of the present invention to provide an image recording apparatus whose image recording portion can be accurately and easily assembled. It is another object of the present invention to provide a method of producing an image recording apparatus accurately and easily.

According to a first aspect of the present invention, there is provided an image recording apparatus, comprising a platen which is adapted to support a recording sheet that is fed in a sheet-feed direction; a recording head which is movable along the platen, in a head-movement direction perpendicular to the sheet-feed direction, so as to record an image on the recording sheet; a frame assembly including a main frame which supports the platen, and at least one slide-base member which is supported by an upper portion of the main frame and which supports the recording head such that the recording head is slideable on the at least one slide-base member along the platen; at least one biasing device which biases the at least one slide-base member toward the main frame in at least a downward direction; and at least one positioning device which positions the at least one slide-base member relative to the main frame in at least one horizontal direction and the downward direction, such that the at least one slide-base member is permitted to be displaced relative to the main frame in an upward direction.

In the present image recording apparatus, the platen and the recording head may be assembled with the frame assembly, as follows: Before the slide-base member is assembled with the main frame, the platen is attached to an appropriate portion of the main frame. Since the slide-base member has not been assembled with the main frame, an operator can easily attach the platen to the main frame. Thus, the operator can easily and accurately position the platen relative to the main frame.

Subsequently, the operator attaches the slide-base member to the main frame, by utilizing the positioning device. Therefore, the slide-base member can be positioned relative to the main frame in the horizontal direction and the downward direction, such that the slide-base member is permitted to be displaced relative to the main frame in the upward direction. Thus, in the state in which the slide-base member is attached to the main frame, the slide-base member extends parallel to the platen.

In addition, the biasing device biases the slide-base member toward the main frame in at least the downward direction. Thus, the slide-base member is prevented from being moved relative to the main frame in at least the upward direction, i.e., is fixed to the main frame. Since the slide-base member is positioned relative, and fixed, to the main frame owing to the biasing device, no local stresses or deformations are produced in the slide-base member or the main frame. Therefore, the slide-base member is not tilted relative to the platen, and is maintained accurately parallel to the same.

Then, the recording head is attached to the slide-base member. Since the slide-base member is attached to the main frame such that the slide-base member extends parallel to the platen, the recording head can be moved on the slide-base member, along the elongate platen, without being tilted relative to the platen.

According to a second aspect of the present invention, there is provided a method of producing an image recording apparatus, the method comprising temporarily assembling a main frame which is for supporting a platen, and at least one slide-base member which is for supporting a recording head such that the recording head is slideable on the at least one slide-base member along the platen, with each other into a frame assembly in which the at least one slide-base member is supported by an upper portion of the main frame such that the at least one slide-base member is permitted to be removed from the main frame in an upward direction, without using a tool; judging whether the at least one slide-base member is appropriately positioned relative to the main frame, such that the at least one slide-base member extends in a first direction parallel to a second direction in which the platen supported by the main frame extends; temporarily removing, when it is judged that the at least one slide-base member is appropriately positioned relative to the main frame, the at least one slide-base member from the main frame in the upward direction; causing the platen to be supported by the main frame; re-assembling the at least one slide-base member with the main frame, so that the at least one slide-base member extends parallel to the platen supported by the main frame; biasing the at least one slide-base member toward the main frame in at least a downward direction; and causing, before or after the at least one slide-base member is re-assembled with the main frame, the recording head to be supported by the at least one slide-base member, so that the recording head is slideable on the at least one slide-base member along the platen supported by the main frame. The tool may be a screw driver.

The image-recording-apparatus producing method in accordance with the second aspect of the present invention enjoys the same advantages as those of the image recording apparatus in accordance with the first aspect of the present invention.

BRIEF DESCRIPTION OF THE DRAWINGS

The above and optional objects, features, and advantages of the present invention will be better understood by reading the following detailed description of the preferred embodiments of the invention when considered in conjunction with the accompanying drawings, in which.

DETAILED DESCRIPTION OF THE PREFERRED EMBODIMENTS

Figure 1:
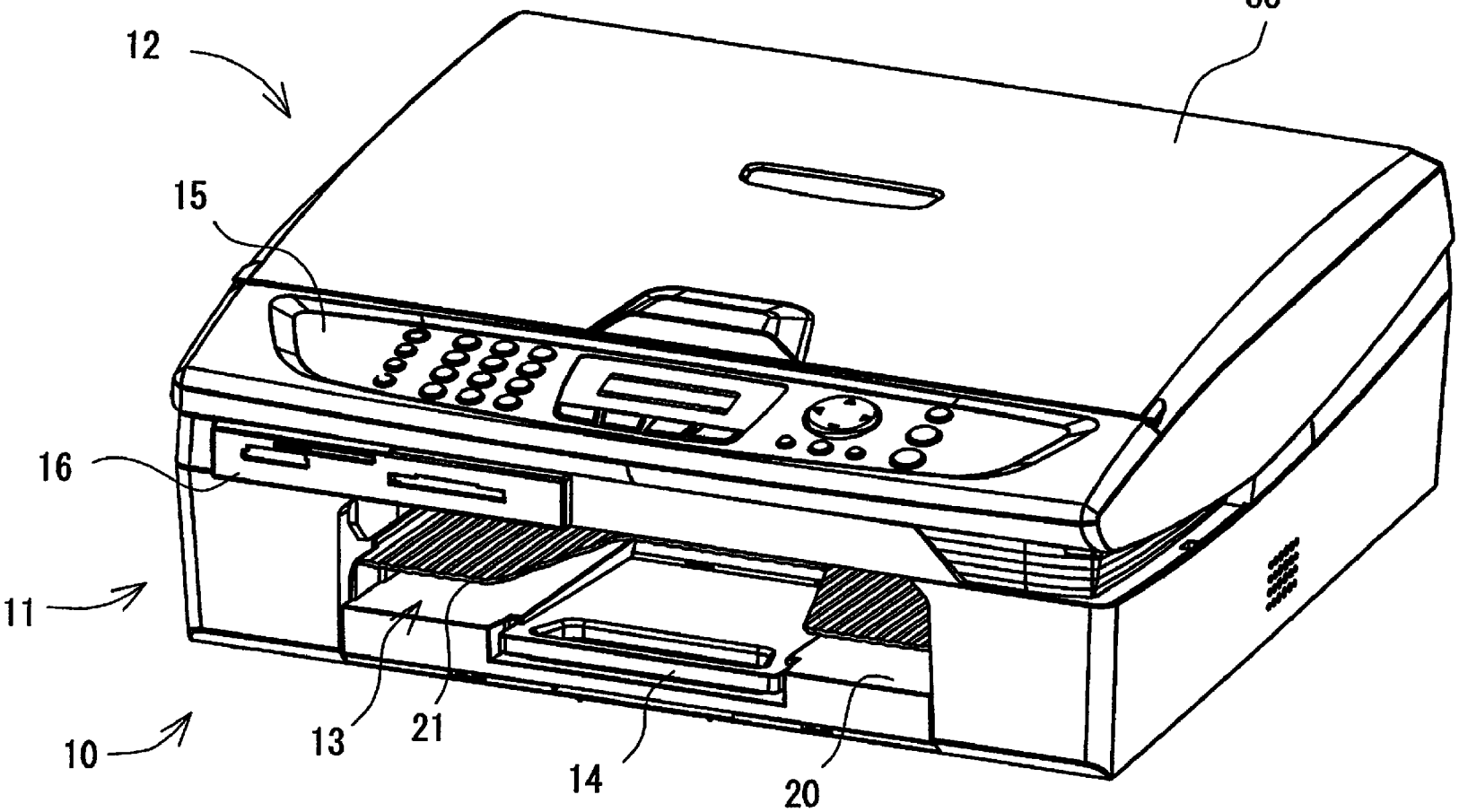
FIG. 1 is a perspective view of a multi-function device (MFD) to which the present invention is applied.

Hereinafter, there will be described preferred embodiments of the present invention by reference to the drawings. FIG. 1 shows an appearance of a "multi-function device (MFD)" 10 as one embodiment of the present invention.

The MFD 10 has a printer function, a scanner function, and a copier function, and includes a printer portion 11 provided in a lower portion thereof, and a scanner portion 12 provided in an upper portion thereof that is integral with the lower portion. In the present embodiment, the printer portion 11 corresponds to an image recording apparatus to which the present invention is applied. The functions other than the printer function may be omitted, that is, the scanner portion 12 may be omitted. Thus, the present invention may be applied to a single-function printer that has only the printer function and does not have the scanner or copier function. Alternatively, the present invention may be applied to an MFD that additionally employs a communication portion and accordingly has a facsimile-machine function.

The MFD 10 as the first embodiment of the present invention is of a small size. However, the present invention may be applied to a large-size MFD that includes a plurality of sheet-supply cassettes and an automatic document feeder (ADF). In addition, the MFD 10 may be connected to a computer (e.g., a personal computer, PC), not shown, so that the MFD 10 may record, based on image data or document data supplied from the computer, an image or a document on a recording sheet. Alternatively, the MFD 10 may be connected to a digital camera, so that the MFD 10 may record, based on image data outputted from the digital camera, an image on a recording sheet. Moreover, the MFD 10 may include a memory receiving portion that can receive each of various sorts of memories, such as a floppy disc, so that the MFD 10 may record, based on image data stored by the each memory, an image on a recording sheet. Here, the recording sheet may be a cut sheet having a fixed size such as A4 Size or B5 Size, a resin-based film, or other sorts of sheets on which images or documents can be recorded.

As shown in FIG. 1, a width and a length of the MFD 10 are greater than a height thereof. Thus, the MFD 10 has a flat appearance having a generally rectangular parallelepiped shape. In the lower portion of the MFD 10, there is provided the printer portion 11. The printer portion 11 includes a front opening 13 formed in a front surface of the MFD 10, and a sheet-supply tray 20 and a sheet-discharge tray 21 that are exposed through the front opening 13. The sheet-supply tray 20 is for storing the recording sheets, and can accommodate sheets of various sizes not larger than A4 Size, such as A4 Size, B5 Size, or Postcard Size. The sheet-supply tray 20 includes a slide member 14 that can be extended, as needed, to increase a sheet-support surface of the tray 20. As will be described later, the recording sheets accommodated by the sheet-supply tray 20 are supplied, one by one, to an image recording portion 24 of the printer portion 11, so that after a desired image is recorded on each recording sheet, the each sheet is discharged onto the sheet-discharge tray 21.

Figure 2:
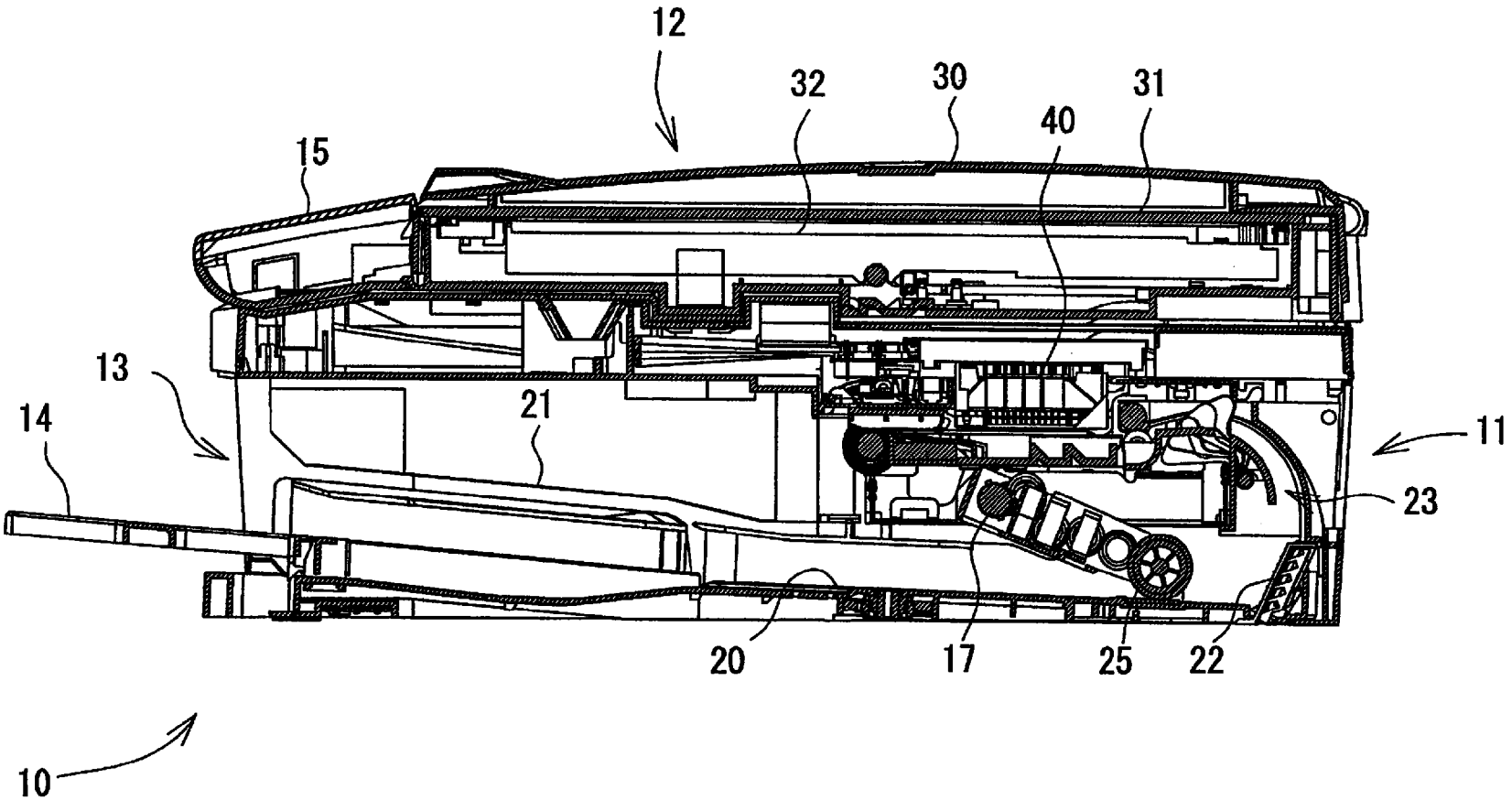
FIG. 2 is a cross-sectional view of the MFD.

In the upper portion of the MFD 10, there is provided the scanner portion 12, i.e., so-called "flat-bed" scanner. As shown in FIGS. 1 and 2, the scanner portion 12 includes a cover member 30 as a top plate that can cover an original sheet placed on an upper surface of a platen glass 31. The cover member 30 is pivotable upward and downward so as to be opened and closed. An image reading carriage 32 is provided below the platen glass 31. The original sheet has an original image to be read by the scanner portion 12. A main scanning direction in which the image reading carriage 32 is moved to read the original image from the original sheet is a lengthwise direction of the MFD 10. Thus, the main scanning direction is a horizontal direction, and one of two first directions each of which is parallel to a horizontal plane as a reference plane and which are perpendicular to each other.

An operation panel 15 is provided in a front end portion of the upper portion of the MFD 10. The operation panel 15 is for operating the printer portion 11 and the scanner portion 12. The operation panel 15 includes various operation keys and a liquid crystal display (LCD) that are used by a user to input various commands to operate the MFD 10. In the case where the MFD 10 is connected to the above-described computer, the MFD 10 is operated according to commands supplied from the computer via a printer driver. The MFD 10 has, in a left, top portion of the front surface thereof (FIG. 1), a slot portion 16 in which each of various sorts of small-size memory cards each as a data memory can be inserted, and the MFD 10 can read image data stored by the each memory card so that based on the thus read image data, images may be displayed by the LCD of the operation panel 15. The user of the MFD 10 can select, by operating the keys of the operation panel 15, one or more desired images from the images displayed on the LCD, so that the printer portion 11 may record the images on the recording sheets, respectively.

Figure 3:
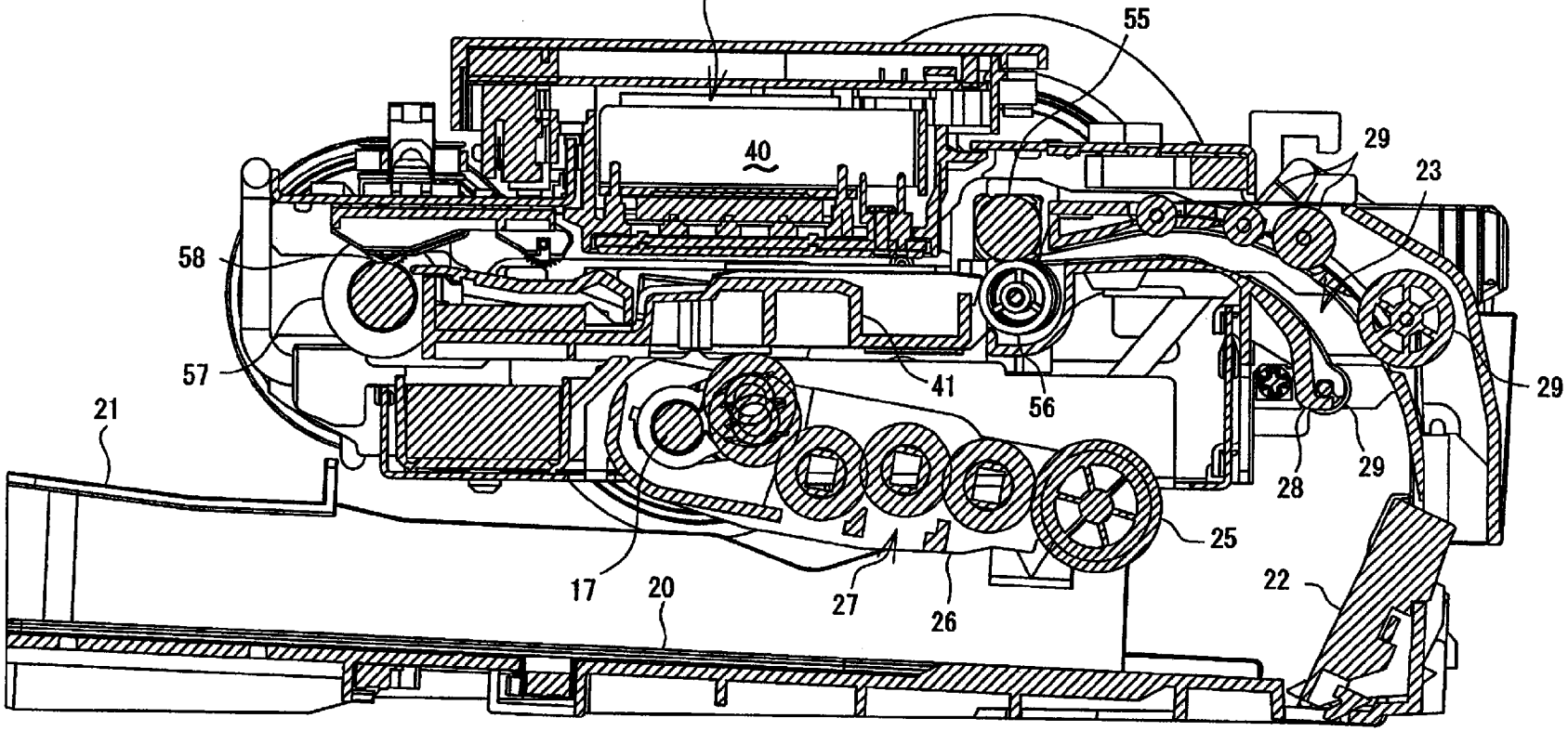
FIG. 3 is a cross-sectional view of a printer portion of the MFD.

As shown in FIGS. 2 and 3, the sheet-supply tray 20 has an inclined sheet-separate plate 22 provided in a downstream-side end portion thereof with respect to a sheet-supply direction in which each recording sheet is supplied from the tray 20. The inclined sheet-separate plate 22 is for separating each of the recording sheets stacked on the sheet-supply tray 20, from the other recording sheets, and guiding a movement of the each separated recording sheet in an upward direction toward a sheet-supply path 23. As shown in FIG. 3, the sheet-supply path 23 first extends upward, then curves toward the front side (i.e., left side in the figure) of the MFD 10, and further extends to the front opening 13. That is, the sheet-supply path 23 extends from the rear side of the MFD 10 toward the front side thereof via the image recording portion 24 and the sheet-discharge tray 21. Thus, the sheet-supply path 23 includes a U-turn portion through which the direction of supplying of each recording sheet is changed from the rearward direction to the frontward direction before the each recording sheet is supplied to the image recording portion 24. After the image recording portion 24 records the image on the each recording sheet, the each sheet is discharged onto the sheet-discharge tray 21.

As shown in FIG. 3, a sheet-supply roller 25 is provided above the sheet-supply tray 20. The sheet-supply roller 25 cooperates with the inclined sheet-separate plate 22 to separate each of the recording sheets stacked on the sheet-supply tray 20, from the other recording sheets, and supply the thus separated recording sheet to the sheet-supply path 23. The sheet-supply roller 25 is rotatably supported by a lower end portion of a sheet-supply arm 26 that is pivotable upward and downward so as to be able to move away, and toward, the sheet-supply tray 20. The sheet-supply arm 26 supports a power transmission device 27 that includes a plurality of gears meshed with each other and that is connected, at one end thereof, to the sheet-supply roller 25. When a LF (line feed) motor, not shown, that is connected to the other end of the power transmission device 27 is driven or rotated, a driving power of the motor is transmitted to the sheet-supply roller 25 via the transmission device 27, so that the roller 25 is rotated to move each recording sheet toward the inclined sheet-separate plate 22.

An upper or base end portion of the sheet-supply arm 26 is supported by an axis member 17 such that the arm 26 is pivotable upward and downward about the axis member 17. In a state in which the sheet-supply tray 20 is set in the MFD 10, a sheet-supply clutch or a spring, not shown, biases the sheet-supply arm 26 toward the sheet-supply tray 20; and in a state in which the sheet-supply tray 20 is not set in the MFD 10, the arm 26 is kept at an upper, retracted position thereof. When the sheet-supply arm 26 is pivoted downward, the sheet-supply roller 25 supported by the lower end portion of the arm 26 is pressed on the uppermost one of the recording sheets stacked on the sheet-supply tray 20. If, in this state, the sheet-supply roller 25 is rotated, a frictional force is produced between an outer circumferential surface of the roller 25 and an upper surface of the uppermost recording sheet and, owing to this frictional force, the uppermost recording sheet is moved toward the inclined sheet-separate plate 22. When the leading end of the uppermost recording sheet engages the inclined sheet-separate plate 22, the recording sheet is guided upward along the sheet-supply path 23. When the uppermost recording sheet is moved toward the inclined sheet-separate plate 22, the underlying recording sheet or sheets may be moved with the uppermost recording sheet, because of the friction or static electricity produced therebetween. However, the further moving of the underlying recording sheet or sheets is prevented by the sheet-separate plate 22.

Except for a portion of the sheet-supply path 23 where the image recording portion 24 is provided, the sheet-supply path 23 is defined and constituted by an outer guide surface and an inner guide surface that are opposed to each other with an appropriate distance therebetween. In the MFD 10, the outer guide surface is constituted by an inner surface of a casing of the printer portion 11, and the inner guide surface is constituted by a surface of a guide member 28 provided inside the casing. One or more guide rollers 29 are provided in one or more curved portions of the sheet-supply path 23, as shown in FIG. 3. The guide rollers 29 are freely rotatable about respective axis lines parallel to a widthwise direction of the sheet-supply path 23, i.e., a direction perpendicular to the drawing sheet of FIG. 3, and are attached to the sheet-supply path 23 such that respective outer circumferential surfaces of the rollers 29 are exposed in the outer or inner guide surface of the path 23. Owing to the guide rollers 29, each recording sheet can be conveyed smoothly while being continuously contacted with the outer and inner guide surfaces of the sheet-supply path 23, even at the curved portions thereof.

Figure 4:
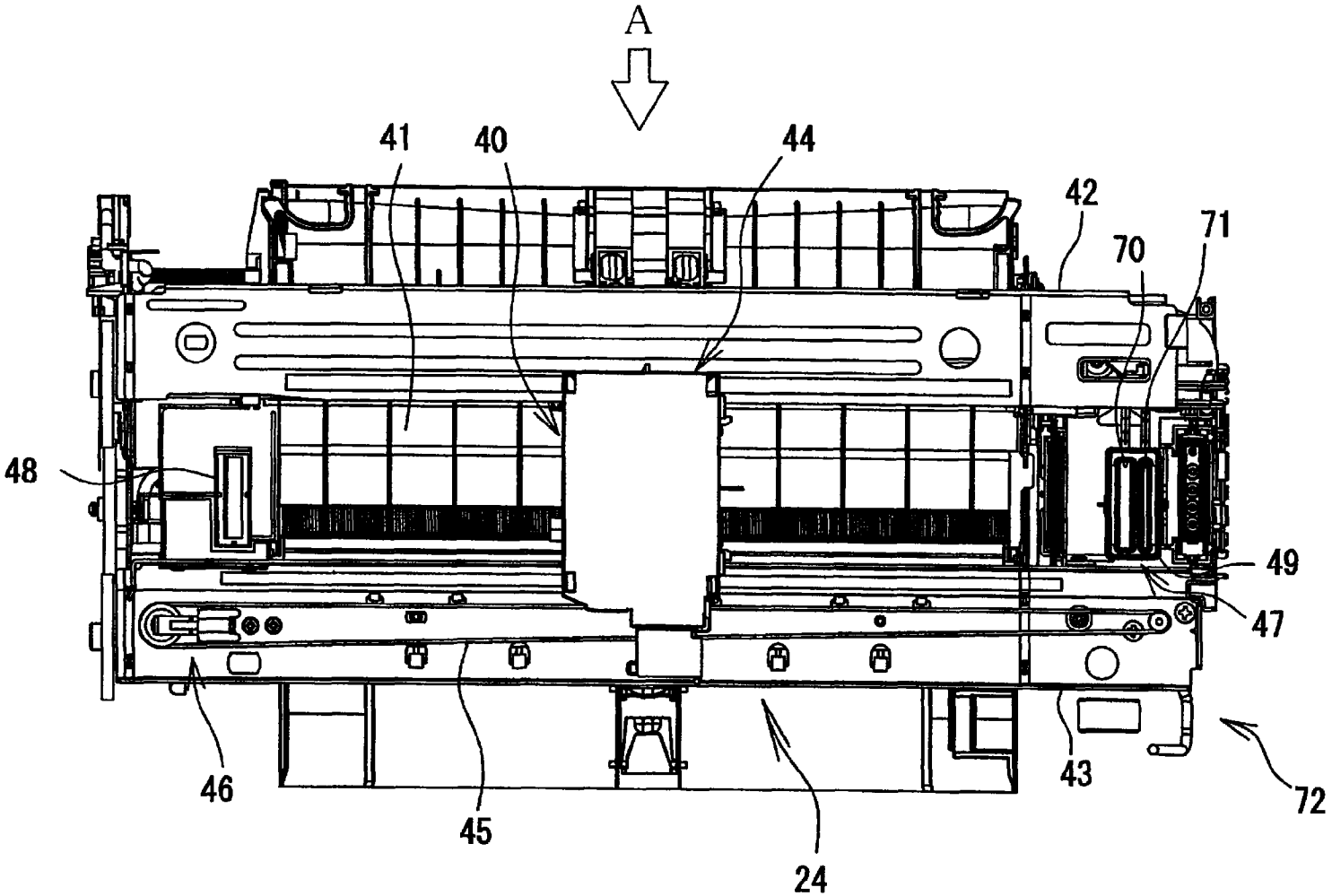
FIG. 4 is a plan view of the printer portion of the MFD.
Figure 7:
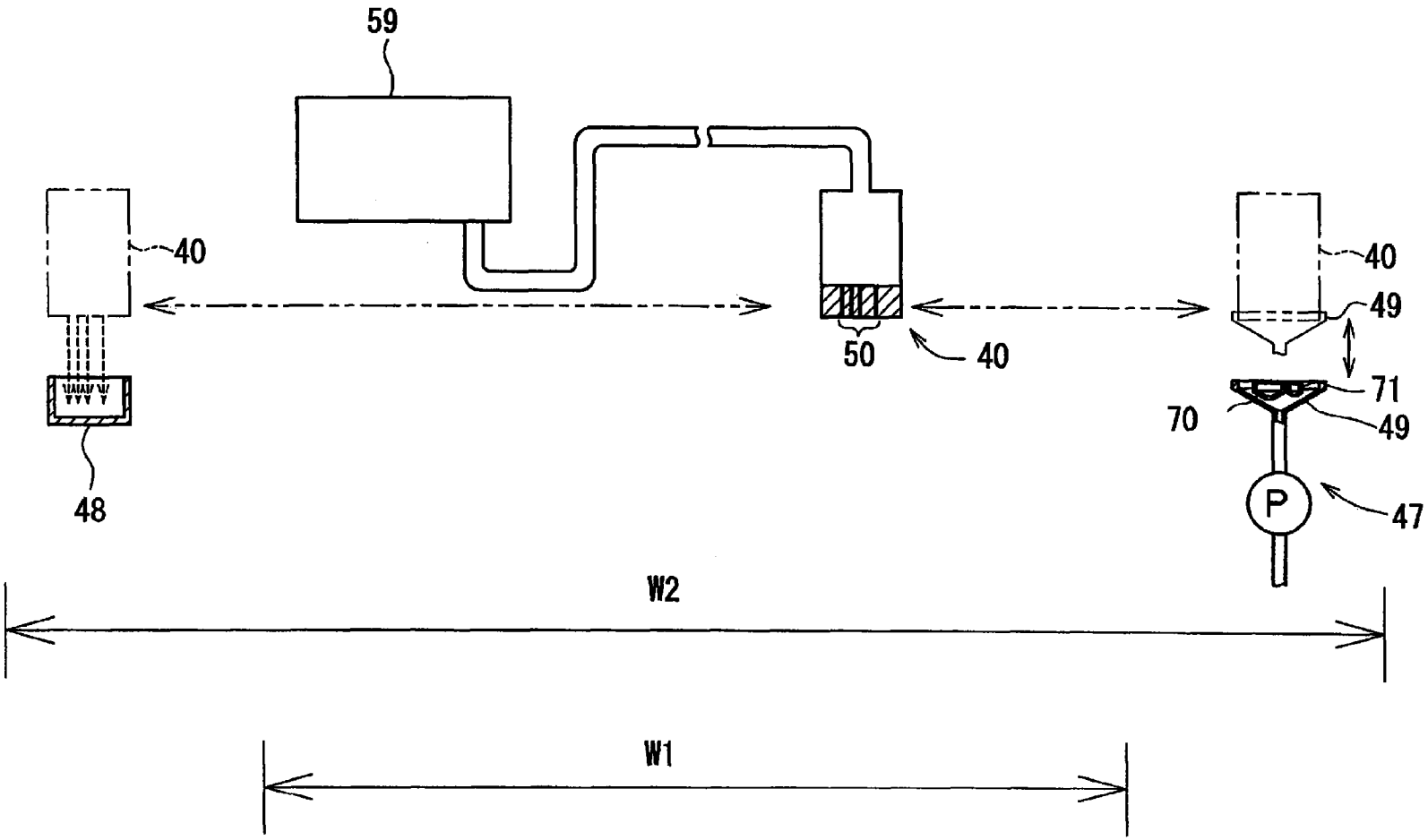
FIG. 7 is an illustrative view showing an ink-supply passage to supply ink to the recording head, and different operation positions of the recording head.

As shown in FIG. 3, the image recording portion 24 is provided on a downstream side of the above-described U-turn portion of the sheet-supply path 23. The recording sheet supplied along the sheet-supply path 23 is nipped by a drive roller 55 (i.e., a feed roller) and a presser roller 56, each described later, and is further fed to the image recording portion 24 in a sheet-feed direction, A, as the other of the two first directions. The sheet-feed direction is a sub-scanning direction in which each recording sheet is fed. As shown in FIGS. 3 and 4, the image recording portion 24 includes an ink-jet recording head 40 as a movable member that can be moved or reciprocated in the main scanning direction as the one of the two first directions, i.e., a head-movement direction perpendicular to the drawing sheet of FIG. 3 and the leftward and rightward directions in FIG. 4. An elongate platen 41 is opposed to the ink-jet recording head 40. Each recording sheet is fed onto the platen 41. Four ink tanks 59 (one ink tank 59 is shown in FIG. 7) are provided in the MFD 10. The four ink tanks 59 store a cyan ink (C), a magenta ink (M), a yellow ink (Y), and a black ink (K), respectively, and supply those inks to the ink-jet recording head 40 via respective ink-supply passages such as flexible tubes.

The ink-jet recording head 40, supplied with the inks, ejects droplets of the inks toward the recording sheet being intermittently stopped on the elongate platen 41, while the head 40 is reciprocated along a predetermined path, in the main scanning direction, i.e., the lengthwise direction of the platen 41. Thus, a desired image is recorded on the recording sheet. To this end, the recording sheet needs to be temporarily stopped on the platen 41. However, the recording head 40 needs to be prevented from ejecting too many ink droplets toward a same position on the recording sheet. Hence, the ink-jet recording head 40 is repeatedly reciprocated in the main scanning direction while the recording sheet is intermittently fed by incremental amounts or distances in the sub-scanning direction. Hereinafter, this sheet-feeding operation will be referred to as the intermittent sheet-feeding operation, where appropriate.

As shown in FIG. 4, the MFD 10 has, in the inner space of the casing of the printer portion 11, a metallic frame assembly 72 including a main frame 73 (FIGS. 8 and 9), described later, and two slide-base members 42, 43 each as a sort of base member that are provided above the sheet-supply path 23. The two slide-base members 42, 43 are distant from each other by an appropriate distance in the sheet-feed direction A, and extend in the widthwise direction of the sheet-supply path 23, i.e., in the lengthwise direction of the platen 41. The ink-jet recording head 40 is mounted on a carriage 44, and the carriage 44 is supported by the two slide-base members 42, 43 such that the carriage 44 is slidable in the widthwise direction of the sheet-supply path 23.

The present invention relates to the metallic frame assembly 72 wherein the two slide-base members 42, 43 are attached to the main frame 73 such that the two slide-base members 42, 43 are positioned relative to the main frame 73 by respective positioning devices, described later, and are biased toward, and thereby fixed to, the same 73 by respective elastic biasing devices, also described later. Since the two slide-base members 42, 43 are attached to the main frame 73 by the positioning devices and the elastic biasing devices, the image recording portion 24 as an image recording apparatus can be assembled easily and accurately.

A carriage driving device 46 is provided on the downstream-side slide-base member 43. The carriage driving device 46 includes an endless, timing belt 45 connected to the carriage 44. The timing belt 45 extends in the widthwise direction of the sheet-supply path 23, and is driven or circulated by a CR (carriage) motor, not shown. When the timing belt 45 is driven, the carriage 44 is moved in the main scanning direction while being supported by the two slide-base members 42, 43.

Figure 5:
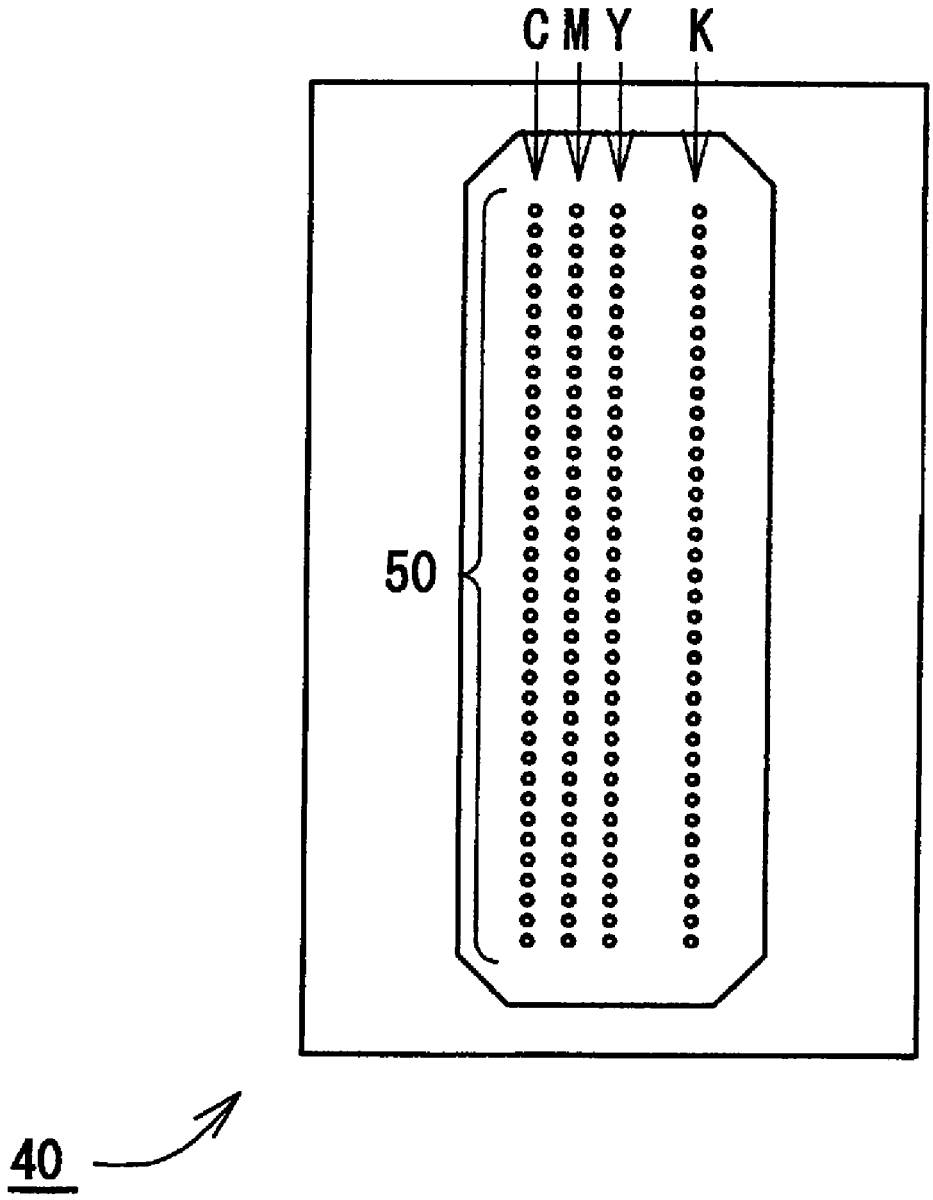
FIG. 5 is an enlarged view showing a lower surface (i.e., a "nozzle-open" surface) of an ink-jet recording head of the MFD.

FIG. 5 shows a lower surface of the ink-jet recording head 40 where four groups of ink ejection nozzles 50 respectively corresponding to the four inks, CMYK, open in a downward direction. Each group of ink ejection nozzles 50 are arranged in an array in the sheet-feed direction A. Thus, four arrays of ink ejection nozzles 50 corresponding to the cyan ink C, the magenta ink M, the yellow ink Y, and the black ink K are provided, in the order of description, in a direction from the left-hand side of the head 40 toward the right-hand side thereof in FIG. 5. In each array, the ink ejection nozzles 50 are provided at an appropriate pitch. However, the pitch of provision of the nozzles 50 in each array and/or the total number of the nozzles 50 provided in the each array may be changed, as needed, depending upon, e.g., a resolution of images recorded by the image recording portion 24. In addition, the total number of the arrays of the ink ejection nozzles 50 may be changed depending upon the total number of the inks used in the MFD 10.

Figure 6:
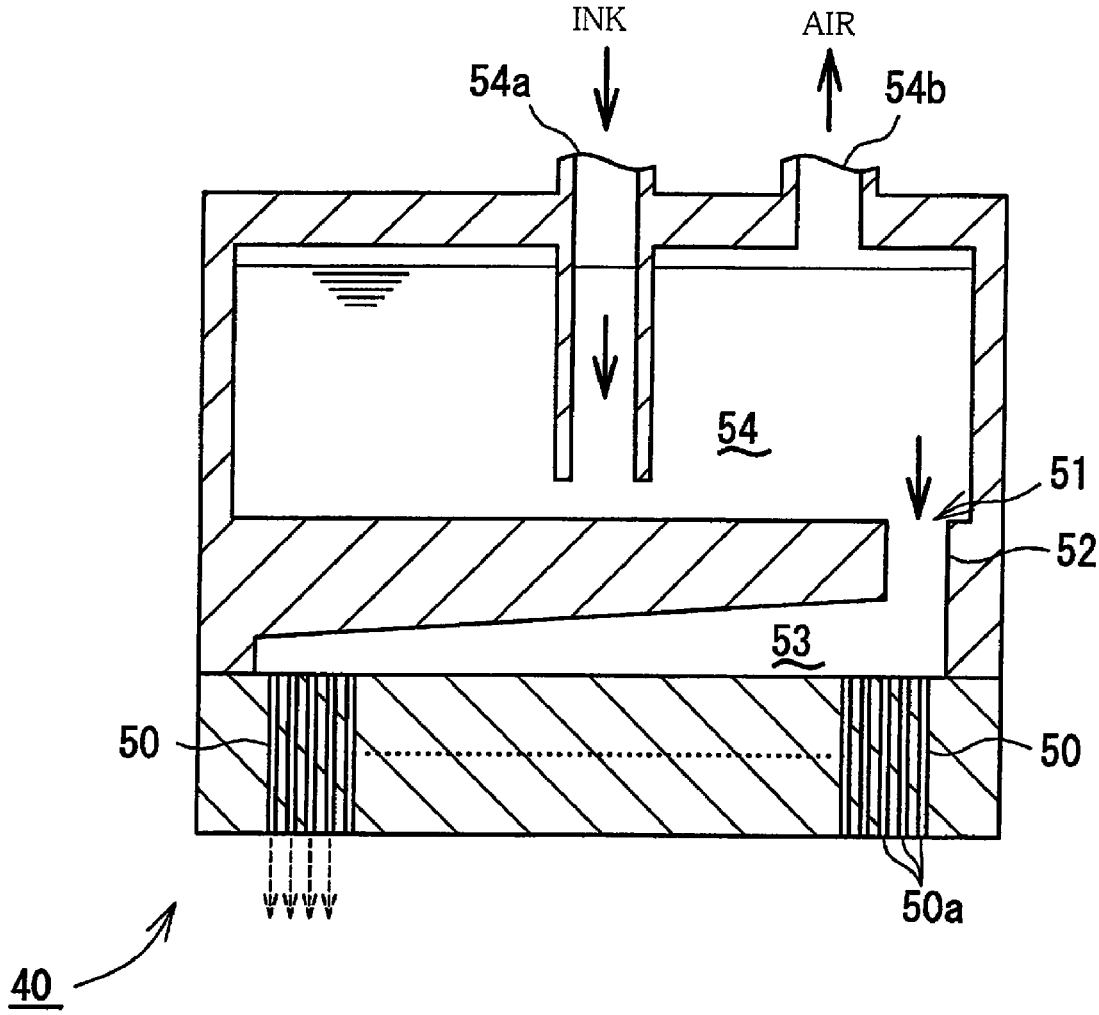
FIG. 6 is an illustrative view showing an internal structure of the ink-jet recording head.

FIG. 6 shows an internal construction of the ink-jet recording head 40. As described above, the four groups of ink ejection nozzles 50 respectively corresponding to the four inks CMYK are arranged in the respective arrays in the sheet-feed direction A. As shown in FIG. 6, the ink ejection nozzles 50 are formed in the lower portion of the ink-jet recording head 40, and the nozzles 50 shown in the figure correspond to the cyan ink C. The ink-et recording head 40 has, above the ink ejection nozzles 50, four manifolds 51 respectively corresponding to the four inks C, M, Y, K. Each of the four manifolds 51 includes a communication passage 52 and a manifold chamber 53, and the ink supplied through the communication passage 52 is delivered to the corresponding group of ink ejection nozzles 50 via the manifold chamber 53.

Each of the four manifold chambers 53 has an inclined surface that is opposed to the corresponding group of ink ejection nozzles 50 and is inclined downward as seen in a direction of flowing of the corresponding ink. Thus, a transverse-cross-section area of each manifold chamber 53 gradually decreases in the direction of flowing of ink. In the present embodiment, walls that define the ink ejection nozzles 50 are formed of a piezoelectric material, and each nozzle 50 ejects, from an opening outlet 50*a* thereof, a droplet of ink when the corresponding wall is deformed. However, each nozzle 50 may be modified to eject droplets of ink in any of different known manners.

The ink-jet recording head 40 has, on respective upstream sides of the four manifolds 51, four buffer tanks 54 respectively corresponding to the four inks C, M, Y, K. Each of the four buffer tanks 54 communicates with a corresponding one of the four manifold chambers 53 via a corresponding one of the four communication passages 52. In addition, the ink-jet recording head 40 has four ink-supply inlets 54*a* that are connected to the four ink tanks 59 (FIG. 7) via the respective ink-supply passages, not shown. Thus, the four inks are supplied from the four ink tanks 59 to the four buffer tanks 54, respectively. Since the inks are not directly supplied from the ink tanks 59 to the ink ejection nozzles 50, i.e., are temporarily stored by the buffer tanks 54, air bubbles produced in the ink supply passages can be trapped or collected in the buffer tanks 54. Thus, the air bubbles can be prevented from entering the ink ejection nozzles 50 and thereby clogging the same 50. The air bubbles collected by the buffer tanks 54 are discharged by suction by a pumping device, not shown, via respective air-discharge outlets 54*b*.

As shown in FIG. 3, the above-described drive roller 55 and the presser roller 56 are provided on the upstream side of the ink-jet recording head 40 with respect to the sheet-supply path 23. The drive roller 55 is driven or rotated by the LF motor, not shown. The drive roller 55 and the presser roller 56 cooperate with each other to nip the recording sheet supplied along the sheet-supply path 23. When the drive roller 55 is rotated, the recording sheet is supplied downstream along the sheet-supply path 23, and is placed on the platen 41. The supplying of recording sheet is monitored by a sheet-supply encoder, not shown. The sheet-supply encoder includes an encoder disc fixed to an axis member of the drive roller 55; and a photo sensor that detects slits of the encoder disc and produces pulse signals corresponding to the detected slits. Thus, a rotation amount of the drive roller 55 is detected through the encoder, and an amount of supplying of the recording sheet is determined by a control device, not shown, based on the thus detected rotation amount.

Another drive roller (i.e., another feed roller) 57 and another presser roller 58 are provided on a downstream side of the ink-jet recording head 40 with respect to the sheet-supply path 23. The second drive roller 57 is driven or rotated by the LF motor, not shown, that drives the first drive roller 55. More specifically described, the second drive roller 57 is rotated in synchronism with the first drive roller 58 via an interlocking device, not shown. The second drive roller 57 and the second presser roller 58 cooperate with each other to nip the recording sheet to which the droplets of inks have been applied. When the second drive roller 57 is rotated, the recording sheet is conveyed downstream along the sheet-supply path 23. The conveying of recording sheet is also monitored by the sheet-supply encoder, not shown. Thus, a rotation amount of the first drive roller 55 is detected as a rotation amount of the second drive roller 57 through the encoder, and an amount of conveying of the recording sheet is determined by the control device, not shown, based on the thus detected rotation amount.

The first presser roller 56 is elastically biased toward the first drive roller 55 so as to press, with an appropriate pressing force, the same 55. Therefore, when the first drive roller 55 and the first presser roller 56 cooperate with each other to nip the recording sheet, the first presser roller 56 is elastically retracted by an amount corresponding to the thickness of the recording sheet. Thus, the rotating force of the first drive roller 55 is reliably transmitted to the recording sheet. This is true with the second drive roller 57 and the second presser roller 58. In the present embodiment, however, the second presser roller 58 presses the recording sheet on which the image has been recorded. Therefore, in order to prevent the deterioration of the image recorded on the recording sheet, the second presser roller 58 is constituted by a spur roller having a plurality of projections along an outer circumferential surface thereof.

The recording sheet, nipped by the first drive roller 55 and the first presser roller 56, is intermittently conveyed, on the platen 41, in incremental amounts each corresponding to one image line recorded on the sheet. Each time a new image line is opened on the recording sheet, the ink-jet recording head 40 is moved in the main scanning direction to traverse the sheet. Thus, an image is recorded in the sub-scanning direction from the leading end of the recording sheet toward the trailing end thereof. The second drive roller 57 and the second presser roller 58 cooperate with each other to nip the leading end of the recording sheet on which the image is being recorded. That is, the recording sheet whose leading-end-side portion is nipped by the first drive roller 55 and the first presser roller 56 and whose trailing-end-side portion is nipped by the second drive roller 57 and the second presser roller 58 is intermittently conveyed in the incremental amounts each corresponding to one image line recorded on the sheet. Thus, the ink-jet recording head 40 records the image on the recording sheet while the sheet is intermittently conveyed in this manner. After the image is recorded in an appropriate area on the recording sheet, the second drive roller 57 is continuously rotated so that the recording sheet, nipped by the second drive roller 57 and the second presser roller 58, is discharged onto the sheet-discharge tray 21.

As shown in FIG. 4, a purging device 47 and a waste-ink tray 48 are provided on either side of the image recording portion 24 in the main scanning direction, i.e., on right-hand and left-hand sides of the same 24 as seen in the figure. That is, the purging device 47 and the waste-ink tray 48 are provided in respective outside areas beyond an image recording area in which the ink-jet recording head 40 records images on recording sheets being conveyed in the sub-scanning direction.

The purging device 47 includes a cap member 49 that covers the lower surface (i.e., "nozzle-open" surface) of the ink-jet recording head 40; a suction pump, not shown, that is connected to the head 40 via the cap member 49; and a moving device, not shown, that moves the cap member 49 toward, and away from, the nozzle-open surface of the head 40. When the moving device is operated, the cap member 49 fluid-tightly covers the nozzle-open surface of the recording head 40. Then, when the suction pump is operated, the inks are sucked from the recording head 40. The suction pump may be of a type in which a flexible tube is sequentially flattened by a roller so as to move air in the tube, or of any known type. The waste-ink tray 48 opens upward, i.e., toward the nozzle-open surface of the recording head 40, and receives or collects the waste inks that are ejected by the head 40 for the purpose of preventing the clogging of the ink ejection nozzles 50.

FIG. 7 illustratively shows the ink supply passage from each of the four ink tanks 59 to the ink-jet recording head 40, and different areas in each of which the head 40 can be moved.

As described above, the ink supplied from each of the four ink tanks 59 to the ink-jet recording head 40 via the ink-supply passage, is temporarily stored by a corresponding one of the four buffer tanks 54 (FIG. 6), so that the air bubbles produced in the ink are collected by the buffer tank 54. Then, the ink is delivered to the corresponding group of ink ejection nozzles 50 via the corresponding communication passage 52 and the corresponding manifold chamber 53, so that each of the nozzles 50 ejects, from the opening outlet 50*a* thereof, droplets of the ink. The ink-jet recording head 40 is moved within an image recording range, W1, while ejecting droplets of the inks toward the recording sheet being conveyed under the recording head 40. Thus, a desired image is recorded on the recording sheet.

As shown in FIG. 7, the purging device 47 and the waste-ink tray 48 are provided in opposite end portions of a movement range W2 of the ink-jet recording head 40 (or the carriage 44), respectively, i.e., in respective outside areas beyond the image recording range W1. As described above, the purging device 47 applies suction to the inks, air bubbles, and foreign matters possibly present in the nozzles 50 of the ink-jet recording head 40, and thereby removes them from the nozzles 50. To this end, the recording head 40 (or the carriage 44) is moved to the right-hand end portion of the movement range W2, and the cap member 49 is moved upward by the moving device of the purging device 47. Thus, the cap member 49 is brought into close contact with the lower surface of the recording head 40, and covers the ink ejection nozzles 50. When the above-described suction pump is operated, a pressure in a space defined by, and between, the recording head 40 and the cap member 49 is lowered, so that the inks are sucked from the nozzles 50 of the recording head 40.

In the present embodiment, the cap member 49 includes a color-ink cap portion 70 and a black-ink cap portion 71 that are formed integrally with each other. The color-ink cap portion 70 is adapted to fluid-tightly cover, altogether, the ink ejection nozzles 50 corresponding to the cyan ink C, the magenta ink M, and the yellow ink Y; and the black-ink cap portion 71 is adapted to fluid-tightly cover only the ink ejection nozzles 50 corresponding to the black ink K. Since the color-ink cap portion 70 and the black-ink cap portion 71 are separate from each other, the color inks C, M, Y are not mixed with the black ink K in the cap member 49 when the inks C, M, Y, K are sucked from the ink-jet recording head 40. Therefore, the inks C, M, Y, K are prevented from being mixed with each other in the ink ejection nozzles 50 of the recording head 40.

The waste-ink tray 48 is for receiving the inks when the ink-jet recording head 40 carries out an idling operation that is called a "flushing" operation. When the flushing operation is carried out, the recording head 40 (or the carriage 44) is moved to the left-hand end portion of the movement range W2, so that the recording head 40 ejects the droplets of inks toward the waste-ink tray 48. However, that the purging device 47 and the waste-ink tray 48 are provided in the right-hand and left-hand end portions of the movement range W2, respectively, is not essentially required. For example, the purging device 47 and the waste-ink tray 48 may be provided vice versa, i.e., in the left-hand and right-hand end portions of the movement range W2, respectively, or may be both provided in one of the two end portions of the range W2.

Figure 8:
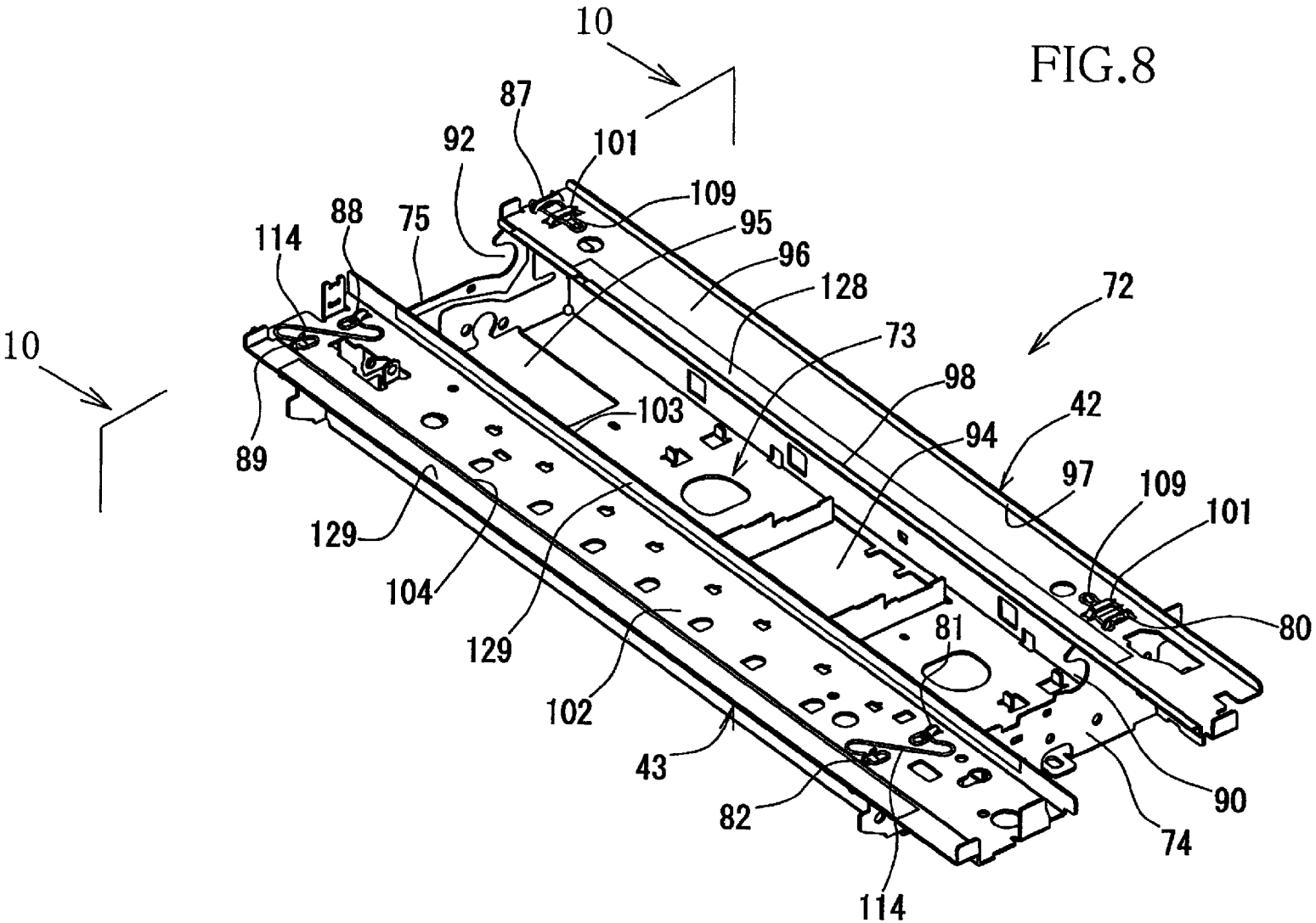
FIG. 8 is a perspective view of a frame assembly of the MFD.
Figure 9:
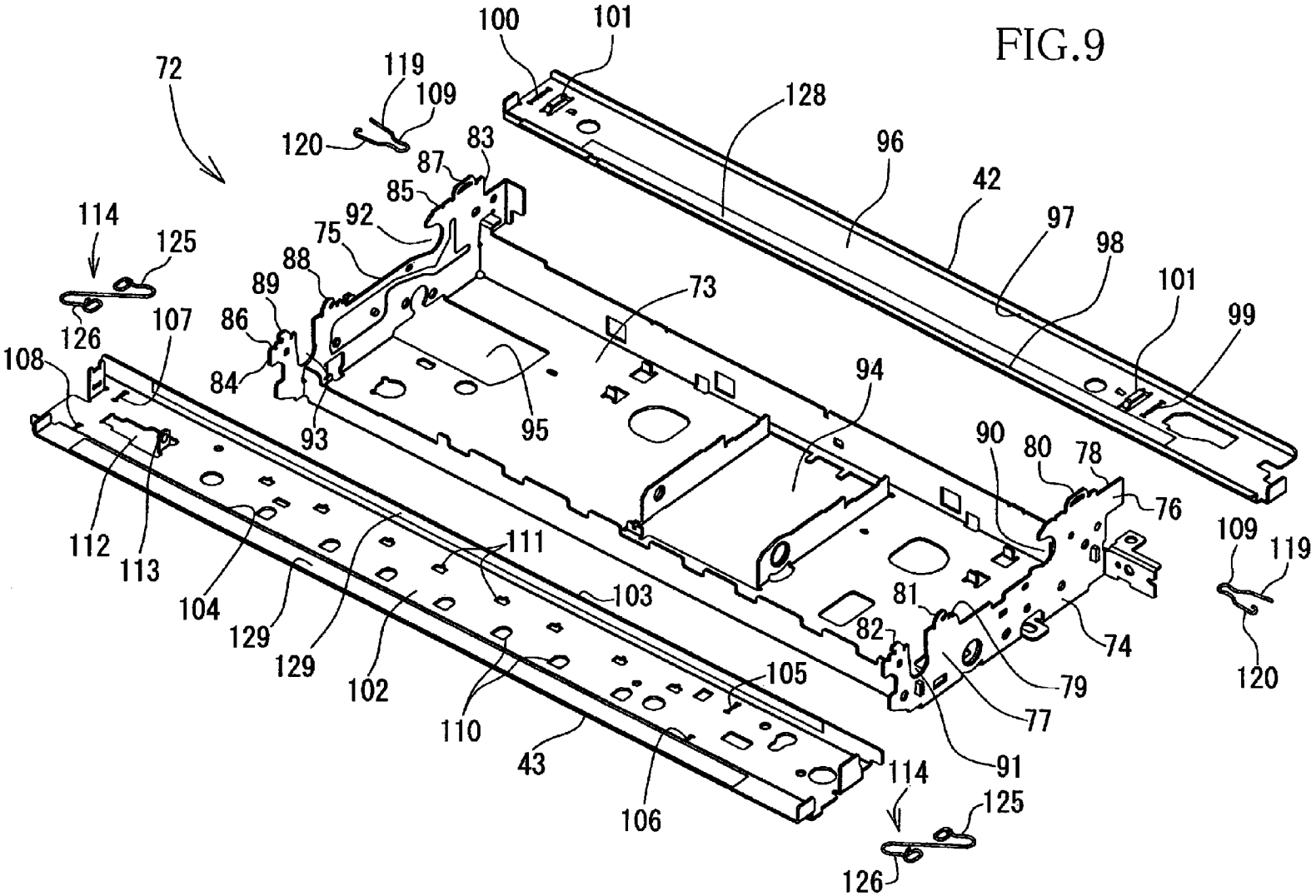
FIG. 9 is an exploded, perspective view of the frame assembly.
Figure 10:
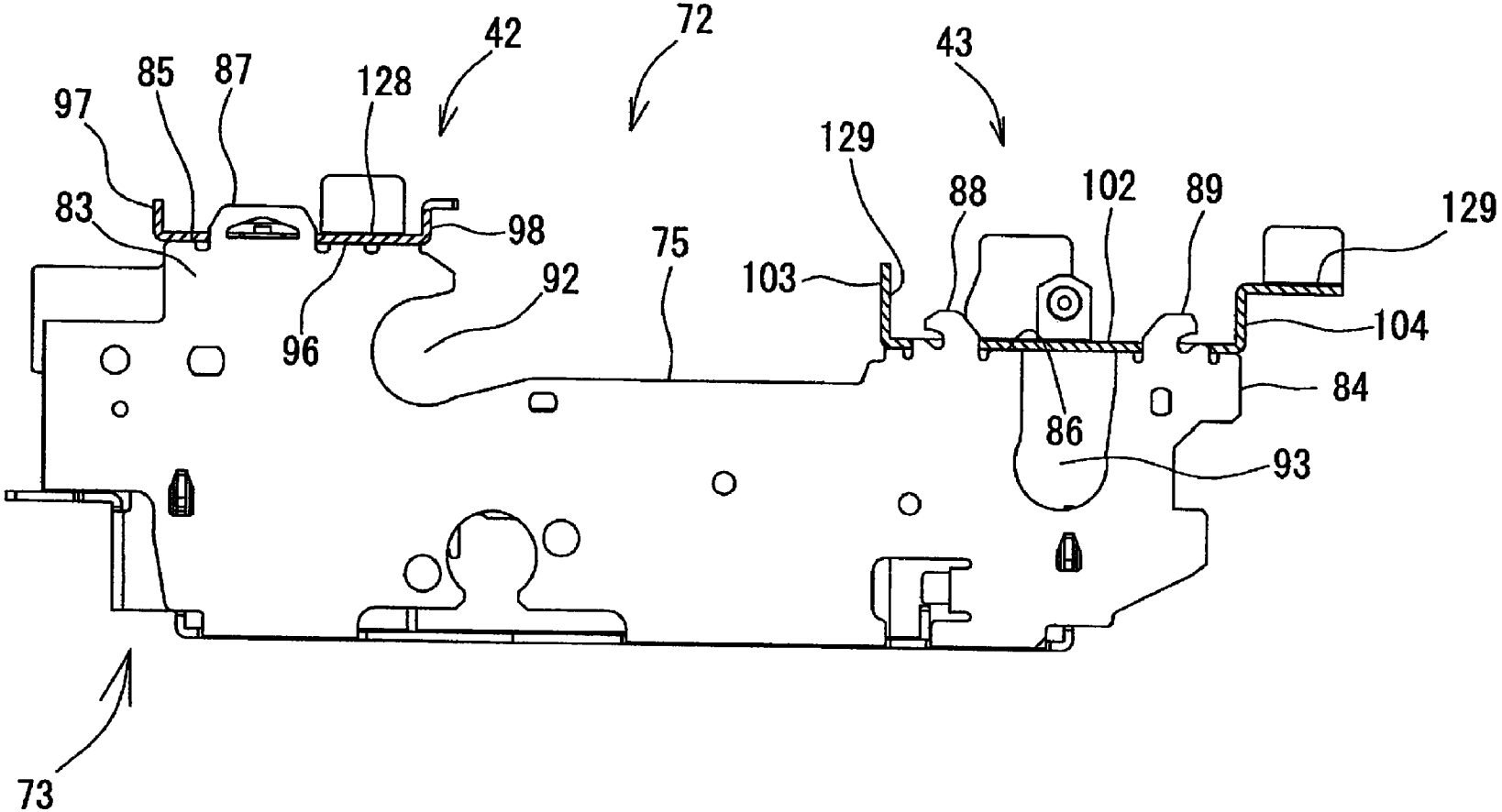
FIG. 10 is a cross-section view taken along 10, 10 in FIG. 8.

Next, the metallic frame assembly 72 will be described in detail by reference to FIGS. 8, 9, and 10. As shown in FIGS. 8 and 9, the metallic frame assembly 72 includes the main frame 73 and the two slide-base members 42, 43 that may be formed of, e.g., an aluminum alloy, any of other nonferrous metals, iron, or steel. The main frame 73 has an elongate, rectangular parallelepiped shape that opens upward. The elongate platen 41 is provided in an inner space of the main frame 73. The elongate platen 41 is positioned relative, and fixed, to the main frame 73, such that a lengthwise direction of the platen 41 is parallel to a lengthwise direction of the main frame 73. Thus, as shown in FIG. 4, the elongate platen 41 is provided such that the platen 41 accurately extends in a horizontal direction, i.e., the main scanning direction.

The main frame 73 has, at lengthwise opposite ends thereof, two end plates 74, 75, respectively, that are integrally formed with the remaining portion of the member 73. More specifically described, the two end plates 74, 75 are formed by bending, upward, lengthwise opposite end portions of a bottom plate of the main frame 73. However, the end plates 74, 75 may be produced independent of the remaining portion of the main frame 73, and may be attached to the remaining portion by appropriate means such as welding.

As shown in FIG. 9, the first end plate 74 includes two shoulder portions 76, 77 (i.e., two slide-base support portions). Respective upper surfaces of the two shoulder portions 76, 77 provide respective slide-base support surfaces 78, 79 that support the two slide-base members 42, 43 (i.e., two base members), respectively. The two support surfaces 78, 79 are so formed as to be accurately horizontal. An engaging projection 80 integrally projects from the support surface 78 of the first shoulder portion 76; and two engaging projections 81, 82 integrally project from the support surface 79 of the second shoulder portion 77. Likewise, the second end plate 75 includes two shoulder portions 83, 84 (i.e., two slide-base support portions). Respective upper surfaces of the two shoulder portions 83, 84 provide respective slide-base support surfaces 85, 86 that support the two slide-base members 42, 43, respectively. The two support surfaces 85, 86 are so formed as to be accurately horizontal. An engaging projection 87 integrally projects from the support surface 85 of the third shoulder portion 83; and two engaging projections 88, 89 integrally project from the support surface 86 of the fourth shoulder portion 84. The projections 80, 81, 82 and the projections 87, 88, 89 are fitted in respective through-holes (i.e., respective engaging recesses) of the two slide-base members 42, 43, as will be described later.

The first end plate 74 has, at respective appropriate positions, two recessed portions 90, 91 (i.e., two bearing portions). Likewise, the second end plate 75 has, at respective appropriate positions, two recessed portions 92, 93 (i.e., two bearing portions). The two recessed portions 90, 92 are located on an axis line parallel to the lengthwise direction of the main frame 73, and are opposed to each other in that direction. Likewise, the two recessed portions 91, 93 are located on another axis line parallel to the lengthwise direction of the main frame 73, and are opposed to each other in that direction. The two recessed portions 90, 92 function as two bearing portions that cooperate with each other to bear the axis member of the first drive roller 55 as the feed roller (FIG. 3); and the two recessed portions 91, 93 function as two bearing portions that cooperate with each other to bear the axis member of the second drive roller 57 as another feed roller (FIG. 3). Thus, the main frame 73 not only supports the platen 41 but also positions and holds the two feed rollers 55, 57.

The main frame 73 has many through-holes and openings including openings 94, 95. Those through-holes and openings are used for avoiding the physical interference of the main frame 73 with various components attached to peripheral devices, or for attaching, to the main frame 73, brackets to which other components are fixed, or for attaching, to the main frame 73, fixing members to fix the frame assembly 72 as a whole to the casing of the printer 11 or the scanner portion 12.

The upstream-side, i.e., first slide-base member 42 is an elongate, plate-like member, and has a generally U-shaped transverse cross section. The first slide-base member 42 extends parallel to the lengthwise direction of the main frame 73, and includes a bottom-wall portion 96 and two side-wall portions 97, 98 respectively provided at widthwise opposite ends of the bottom-wall portion 96. An upper surface of the bottom-wall portion 96 supports one end portion of the carriage 40 carrying the ink-jet recording head 40, such that the carriage 40 is movable relative to the bottom-wall portion 96. A low-friction tape 128 having a low friction coefficient is adhered to a portion of the bottom-wall portion 96 that supports the one end portion of the carriage 44 and guides the movement of the same 44. Thus, the carriage 44 can be smoothly moved along the first slide-base member 42.

The bottom-wall portion 96 of the first slide-base member 42 has two elongate through-holes 99, 100 (e.g., two engaging recesses). As shown in FIG. 10, the two projections 80, 87 of the main frame 73 fit in the two through-holes 99, 100, respectively. The size of each of the through-holes 99, 100 corresponds to the size of each of the projections 80, 87. Therefore, in the state in which the two projections 80, 87 fit in the two through-holes 99, 100, respectively, the bottom-wall portion 96 of the first slide-base member 42 is held in close contact with the two support surfaces 78, 85 of the main frame 73, and the first slide-base member 42 is positioned relative to the shoulder portions 76, 83. Since the two projections 80, 87 just fit upward into the two through-holes 99, 100, respectively, the first slide-base member 42 is positioned relative to the main frame 73, with respect to two horizontal directions (i.e., two first directions) intersecting each other, and a downward direction (i.e., a second direction), such that the first slide-base member 42 is permitted to be moved or displaced in an upward direction (i.e., a third direction). Thus, the two shoulder portions 76, 83, the two projections 80, 87 respectively provided on the two shoulder portions 76, 83, and the two through-holes 99, 100 in which the two projections 80, 87 respectively fit cooperate with each other to constitute a first positioning device that positions the first slide-base member 42 relative to the main frame 73 in the above-described manner. In the present embodiment, the first slide-base member 42 is positioned relative to the main frame 73, by utilizing the fitting of the projections 80, 87 in the through-holes 99, 100. However, it is possible to utilize the fitting of the projections 80, 87 in the through-holes 99, 100, just for the purpose of placing the first slide-base member 42 on the main frame 73, while the positioning of the first slide-base member 42 relative to the main frame 73 is done by a different positioning device.

As shown in FIGS. 8 and 9, the bottom-wall portion 96 of the first slide-base member 42 has two spring accommodating portions 101 at respective positions adjacent the two through-holes 99, 100. Each of the two spring accommodating portions 101 has an arcuate shape since the each spring accommodating portion 101 is formed by fixing opposite end portions of an arcuate plate to the bottom-wall portion 96. However, the two spring accommodating portions 101 may be formed by cutting and bending respective portions of the bottom-wall portion 96. The two spring holding portions 101 accommodate respective spring members 109 (i.e., biasing members or elastic members) that cooperate with each other to bias, and thereby fix, the first slide-base member 42 toward, and to, the main frame 73. Like the main frame 73, the first slide-base member 42 has appropriate through-holes and openings that are used for avoiding the physical interference of the first slide-base member 42 with various components attached to peripheral devices, or for attaching, to the first slide-base member 42, brackets to which other components are fixed.

Like the first slide-base member 42, the downstream-side, i.e., second slide-base member 43 is an elongate, plate-like member, and has a generally U-shaped transverse cross section. The second slide-base member 43 is distant from, and is opposed to, the first slide-base member 42 in the sheet-feed direction A (FIG. 4). The second slide-base member 43 extends parallel to the lengthwise direction of the main frame 73, and includes a bottom-wall portion 102 and two side-wall portions 103, 104 respectively provided at widthwise opposite ends of the bottom-wall portion 102. The first side-wall portion 103 fit in a groove, not shown, formed in the carriage 44, and an upper surface of the bottom-wall portion 102 supports another end portion of the carriage 40, such that the carriage 40 is movable relative to the second slide-base member 43. Low-friction tapes 129 having a low friction coefficient are adhered to portions of the first side-wall portion 103 that fit in the groove of the carriage 44, and to a portion of the bottom-wall portion 102 that supports the other end portion of the carriage 44 and guides the movement of the same 44. Thus, the carriage 44 can be smoothly moved along the second slide-base member 43. As shown in FIG. 4, the carriage 44 carrying the ink-jet recording head 40 bridges the first and second slide-base members 42, 43 and, when the driving device 46 drives the timing belt 45, the recording head 40 is moved in the main scanning direction, i.e., the lengthwise direction of the platen 41.

The bottom-wall portion 102 of the second slide-base member 43 has two elongate through-holes 105, 106 (e.g., two engaging recesses) and two elongate through-holes 107, 108 (e.g., two engaging recesses). As shown in FIG. 10, the two projections 81, 82 of the main frame 73 fit in the two through-holes 105, 106, respectively, and the two projections 88, 89 of the main frame 73 fit in the two through-holes 107, 108, respectively. The respective sizes of the through-holes 105, 106, 107, 108 correspond to the respective sizes of the projections 81, 82, 88, 89. Therefore, in the state in which the four projections 81, 82, 88, 89 fit in the four through-holes 105, 106, 107, 108, respectively, the bottom-wall portion 102 of the second slide-base member 43 is held in close contact with the two support surfaces 79, 86 of the main frame 73, and the second slide-base member 43 is positioned relative to the shoulder portions 77, 84 in the two horizontal directions and the downward direction. Since the two projections 81, 82 just fit upward in the two through-holes 105, 106, respectively, and the two projections 88, 89 just fit upward in the two through-holes 107, 108, respectively, the second slide-base member 43 is positioned relative to the main frame 73, with respect to the two horizontal directions and the downward direction, such that the second slide-base member 43 is permitted to be moved or displaced in the upward direction. Thus, the two shoulder portions 77, 84, the four projections 81, 82, 88, 89 provided on the two shoulder portions 77, 84, and the four through-holes 105, 106, 107, 108 in which the four projections 81, 82, 88, 89 respectively fit cooperate with each other to constitute a second positioning device that positions the second slide-base member 43 relative to the main frame 73 in the above-described manner. As will be described later, two spring members 114 (i.e., biasing members or elastic members) cooperate with each other to bias, and thereby fix, the second slide-base member 43 toward, and to, the main frame 73. In the present embodiment, the second slide-base member 43 is positioned relative to the main frame 73, by utilizing the fitting of the projections 81, 82, 88, 89 in the through-holes 105, 106, 107, 108. However, it is possible to utilize the fitting of the projections 81, 82, 88, 89 in the through-holes 105, 106, 107, 108, just for the purpose of placing the second slide-base member 43 on the main frame 73, while the positioning of the second slide-base member 43 relative to the main frame 73 is done by a different positioning device.

As shown in FIG. 9, like the first slide-base member 42, the second slide-base member 43 has appropriate through-holes and openings 110, 111, 112 and an upright plate 113 that are used for avoiding the physical interference of the second slide-base member 43 with various components attached to peripheral devices, or for attaching, to the second slide-base member 43, brackets to which holders to hold pulleys of the driving device 46 and other components are fixed.

Figure 11:
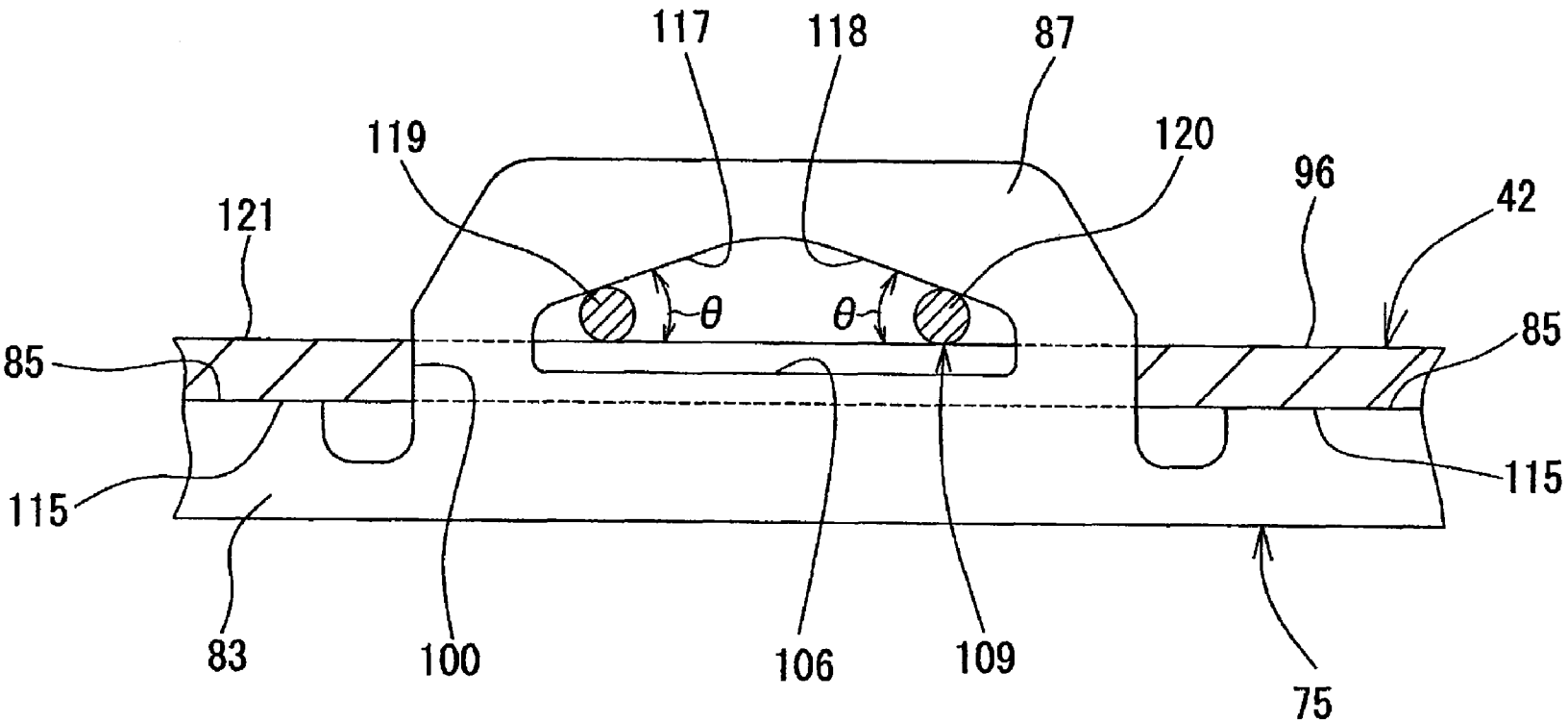
FIG. 11 is an enlarged view of a pertinent portion of the frame assembly of FIG. 10.

FIG. 11 shows a state in which the first slide-base member 42 is placed on the shoulder portion 83 of the second end plate 75 of the main frame 73.

As described above, the through-hole 100 of the first slide-base member 42 and the projection 87 of the shoulder portion 83 of the main frame 73 are aligned with each other, and the projection 87 is fitted in the through-hole 100, as shown in FIG. 9. Consequently a lower surface 115 of the bottom-wall portion 96 of the first slide-base member 42 is supported by the support surface 85 of the shoulder portion 83, as shown in FIG. 11. Similarly, the through-hole 99 of the first slide-base member 42 and the projection 80 of the shoulder portion 76 of the main frame 73 are aligned with each other, and the projection 80 is fitted in the through-hole 99, as shown in FIG. 9. Consequently the lower surface 115 of the bottom-wall portion 96 is supported by the support surface 78 of the shoulder portion 76.

As shown in FIG. 11, the projection 87 is fitted in the through-hole 100 and, as shown in FIG. 9, the projection 80 is fitted in the through-hole 99. Thus, as described above, the first slide-base member 42 is positioned relative to the main frame 73 in the horizontal directions and the downward direction. Since the two support surfaces 85, 78 that cooperate with each other to support the first slide-base member 42 are so formed as to be accurately horizontal, the first slide-base member 42 is so positioned as to be accurately horizontal. Therefore, the first slide-base member 42 is so positioned as to be accurately parallel to the elongate platen 41.

As shown in FIG. 11, the projection 87 has a generally pentagonal through-hole 106 that is formed through a thickness thereof and has two inclined surfaces 117, 118 that are symmetric with each other with respect to a vertical plane perpendicular to the horizontal plane. Each of the two inclined surfaces 117, 118 has an acute angle, θ, relative to the horizontal plane parallel to an upper surface 121 of the bottom-wall portion 96 of the first slide-base member 42. In the present embodiment, the acute angle θ is about 15 degrees. However, the acute angle θ may fall in the range of from 10 degrees to 20 degrees. In the state in which the projection 87 is fitted in the through-hole 100, an upper portion of the projection 87 projects upward from the through-hole 100, and the two inclined surfaces 117, 118 are positioned above the upper surface 121 of the bottom-wall portion 96 of the first slide-base member 42. Like the projection 87, the projection 80 has the above-described through-hole 106 and two inclined surfaces 117, 118.

The above-described two spring members 109 are fitted in the respective through-holes 106 of the two projections 87, 80. As shown in FIG. 9, each spring member 109 is formed of a metallic wire (e.g., a spring-steel wire), and has a generally V-shaped, symmetric configuration extending along the horizontal plane. More specifically described, each of the two spring members 109 includes two leg portions 119, 120 that can be elastically deformed in opposite directions in which the two leg portions 119, 120 can be moved toward, and away from, each other, and that are adapted to engage the two inclined surfaces 117, 118, respectively, of a corresponding one of the two projections 87, 80.

As shown in FIG. 8, first, each of the two spring members 109 is elastically deformed by fingers of an operator such that the two leg portions 119, 120 thereof are moved toward each other, and then the two leg portions 119, 120 are inserted into a corresponding one of the respective through-holes 106 (FIG. 11) of the two projections 87, 80 and a corresponding one of the two spring accommodating portions 101. Since each of the two spring members 109 engages a corresponding one of the two projections 87, 80, each of the two projections 87, 80 also functions as a spring holding portion (i.e., an elastic-member holding portion) that holds the corresponding spring member 109 (i.e., the corresponding elastic member).

If the operator releases each spring member 109 after it is fitted in the corresponding through-hole 106 and the corresponding spring accommodating portion 101, the each spring member 109 is elastically restored to its original shape, i.e., the two leg portions 119, 120 thereof are moved away from each other along the horizontal, upper surface 121 of the bottom-wall portion 96 of the first slide-base member 42. Consequently the two leg portions 119, 120 of each spring member 109 are elastically pressed against the two inclined surfaces 117, 118 of the corresponding projection 87, 80, respectively. Since the two inclined surfaces 117, 118 are inclined in the above-described manner, the two leg portions 119, 120 that are being elastically pressed against the two inclined surfaces 117, 118, respectively, are moved toward the bottom-wall portion 96 of the first slide-base member 42, while being guided by the two inclined surfaces 117, 118, respectively. Thus, the two leg portions 119, 120 of each spring member 109 are pressed, owing to the respective elastic forces thereof, against the upper surface 121 of the bottom-wall portion 96 of the first slide-base member 42, and the first slide-base member 42 is elastically biased toward the two shoulder portions 83, 76 of the main frame 73, owing to the respective pressing forces caused by the respective elastic forces of the two spring members 109.

The two spring members 109 and the two projections 87, 80 cooperate with each other to constitute a first elastically biasing device that elastically biases the first slide-base member 42 toward the main frame 73. Since the two spring members 109 are attached to the frame assembly 72 in the above-described manner, the first slide-base member 42 is accurately attached or fixed to the main frame 73, such that the first slide-base member 42 extends accurately parallel to the elongate platen 41 positioned relative to the main frame 73. Moreover, since the two spring members 109 can be easily removed from the frame assembly 72, the first slide-base member 42 is easily detachable from the main frame 73.

Figure 12:
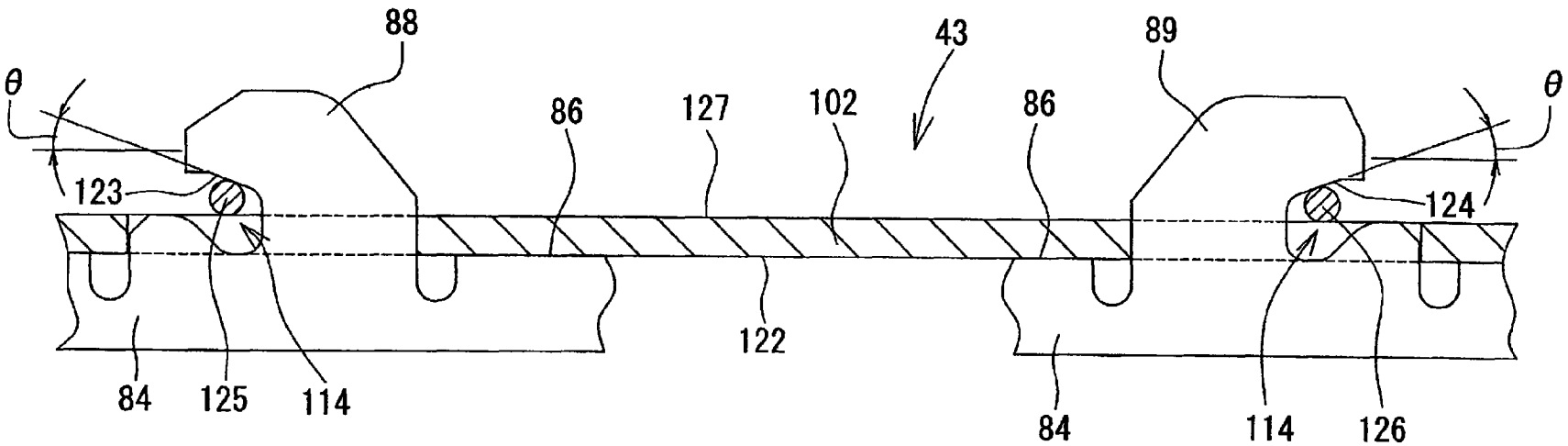
FIG. 12 is an enlarged view of another pertinent portion of the frame assembly of FIG. 10.
Figure 13:
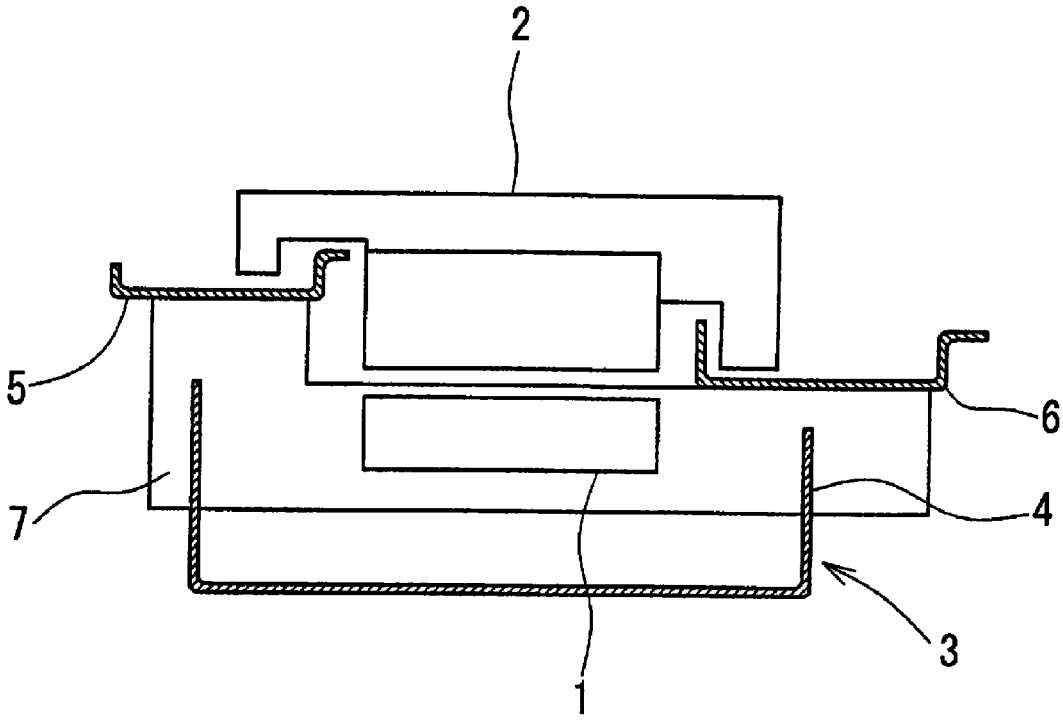
FIG. 13 is an illustrative, cross-section view of an image recording portion of a conventional ink-jet recording device.

FIG. 12 shows a state in which the second slide-base member 43 is placed on the shoulder portion 84 of the second end plate 75 of the main frame 73.

Like the first slide-base member 42, the through-holes 107, 108 of the second slide-base member 43, and the projections 88, 89 of the shoulder portion 84 of the main frame 73 are aligned with each other, and the projections 88, 89 are fitted in the through-holes 107, 108, as shown in FIG. 9. Consequently a lower surface 122 of the bottom-wall portion 102 of the second slide-base member 43 is supported by the support surface 86 of the shoulder portion 84, as shown in FIG. 12. Similarly, the through-holes 105, 106 of the second slide-base member 43, and the projections 81, 82 of the shoulder portion 77 of the main frame 73 are aligned with each other, and the projections 81, 82 are fitted in the through-holes 105, 106, as shown in FIG. 9. Consequently the lower surface 122 of the bottom-wall portion 102 is supported by the support surface 79 of the shoulder portion 77.

As shown in FIG. 12, the two projections 88, 89 are fitted in the two through-holes 107, 108 and, as shown in FIG. 9, the two projections 81, 82 are fitted in the two through-holes 105, 106. Thus, as described above, the second slide-base member 43 is positioned relative to the main frame 73 in the horizontal directions and the downward direction. Since the two support surfaces 86, 79 that cooperate with each other to support the second slide-base member 43 are so formed as to be accurately horizontal, the second slide-base member 43 is so positioned as to be accurately horizontal. Therefore, the second slide-base member 43 is so positioned as to be accurately parallel to the elongate platen 41.

As shown in FIG. 12, each of the two projections 88, 89 has a hook-like shape, and the two projections 88, 89 have respective inclined surfaces 123, 124 that are symmetric with each other with respect to a vertical plane. Each of the two inclined surfaces 123, 124 has an acute angle, θ, relative to the horizontal plane parallel to an upper surface 127 of the bottom-wall portion 102 of the second slide-base member 43. In the present embodiment, the acute angle θ is about 15 degrees. However, the acute angle θ may fall in the range of from 10 degrees to 20 degrees. In the state in which the projections 88, 89 are fitted in the through-holes 107, 108, respective upper portions of the projections 88, 89 project upward from the through-holes 107, 108, and the two inclined surfaces 123, 124 of each projection 88, 89 are positioned above the upper surface 127 of the bottom-wall portion 102 of the second slide-base member 43. Like the projections 88, 89, the projections 81, 82 have respective hook-like shapes and have the above-described two inclined surfaces 123, 124.

One of the above-described two spring members 114 is engaged with the two projections 88, 89; and the other spring member 114 is engaged with the two projections 81, 82. As shown in FIG. 9, each spring member 114 is formed of a metallic wire (e.g., a spring-steel wire), and has a generally S-shaped, symmetric configuration extending along the horizontal plane. More specifically described, each of the two spring members 114 includes two leg portions 125, 126 that can be elastically deformed in opposite directions in which the two leg portions 125, 126 are moved toward, and away from, each other, and that are adapted to engage the two inclined surfaces 123, 124, respectively, of the corresponding one pair of projections 88, 89, or 81, 82.

As shown in FIG. 8, first, each of the two spring members 114 is elastically deformed by the fingers of the operator such that the two leg portions 125, 126 thereof are moved away from each other, and then the two leg portions 125, 126 are engaged with the respective inclined surfaces 123, 124 of the corresponding one pair of projections 88, 89, or 81, 82. Since each of the two spring members 114 engages the corresponding one pair of projections 88, 89, or 81, 82, each pair of projections 88, 89, or 81, 82 also functions as a spring holding portion (i.e., an elastic-member holding portion) that holds the corresponding spring member 114 (i.e., the corresponding elastic member).

If the operator releases each spring member 114 after it is engaged with the corresponding one pair of projections 88, 89, or 81, 82, the each spring member 114 is elastically restored to its original shape, i.e., the two leg portions 125, 126 thereof are moved toward each other along the horizontal, upper surface 127 of the bottom-wall portion 102 of the second slide-base member 43. Consequently the two leg portions 125, 126 of each spring member 114 are elastically pressed against the respective inclined surfaces 125, 126 of the corresponding pair of projections 88, 89, or 81, 82. Since the two inclined surfaces 123, 124 are inclined in the above-described manner, the two leg portions 125, 126 that are being elastically pressed against the two inclined surfaces 123, 124, respectively, are moved toward the bottom-wall portion 102 of the second slide-base member 43, while being guided by the two inclined surfaces 123, 124, respectively. Thus, the two leg portions 125, 126 of each spring member 114 are pressed, owing to the respective elastic forces thereof, against the upper surface 127 of the bottom-wall portion 102 of the second slide-base member 43, and the second slide-base member 43 is elastically biased toward the two shoulder portions 84, 77 of the main frame 73, owing to the respective pressing forces caused by the respective elastic forces of the two spring members 114.

The two spring members 114 and the four projections 88, 89, 81, 82 cooperate with each other to constitute a second elastically biasing device that elastically biases the second slide-base member 43 toward the main frame 73. Since the two spring members 114 are attached to the frame assembly 72 in the above-described manner, the second slide-base member 43 is accurately attached or fixed to the main frame 73, such that the second slide-base member 43 extends accurately parallel to the elongate platen 41 positioned relative to the main frame 73. Moreover, since the two spring members 114 can be easily removed from the frame assembly 72, the second slide-base member 43 is easily detachable from the main frame 73.

In the MFD 10 constructed as described above, the image recording portion 24 is produced in the following method: First, the first and second slide-base members 42, 43 are assembled with the main frame 73 so as to provide the frame assembly 72. Then, whether this frame assembly 72 has a designed or required accuracy, i.e., whether the two slide-base members 42, 43 are sufficiently accurately positioned relative to the main frame 73 is judged or inspected. Unless the slide-base members 42, 43 are sufficiently accurately positioned relative to the main frame 73, and unless the inaccuracy can be corrected, then the frame assembly 72 is discarded as a defective one.

On the other hand, the frame assembly 72 that has passed the inspection is temporarily disassembled into the main frame 73 and the two slide-base members 42, 43, without using a tool such as a screw driver. Then, the platen 41 is attached to an appropriate position or portion of the main frame 73 free of the slide-base members 42, 43. Since the slide-base members 42, 43 are not attached to the main frame 73, the operator can easily attach the elongate platen 41 to the main frame 73. Therefore, the platen 41 can be easily and accurately positioned relative to the appropriate portion of the main frame 73.

Subsequently, each of the two slide-base members 42, 43 is attached to the main frame 73, with the corresponding positioning device and the corresponding elastically biasing device. Therefore, the two slide-base members 42, 43 can be positioned relative to the platen 41 such that the elongate slide-base members 42, 43 extend accurately parallel to the elongate platen 41. Since the slide-base members 42, 43 are positioned relative, and fixed, to the main frame 73 owing to the respective elastic forces of the spring members 109, 114, no local stresses or deformations are produced in the slide-base members 42, 43 or the main frame 73. Thus, the slide-base members 42, 43 are not tilted relative to the platen 41, and are maintained accurately parallel to the same 41. In addition, since the slide-base members 42, 43 are fixed to the main frame 73 without using any bolts or nuts, it is not needed to provide, in the frame assembly 72, any spaces in which the bolts or nuts are to be disposed. Thus, the MFD 10 can enjoy a reduced size.

Then, the ink-jet recording head 40 is attached to the two slide-base members 42, 43. Since the two slide-base members 42, 43 are attached to the main frame 73 such that the slide-base members 42, 43 extend parallel to the platen 41, the recording head 40 can be moved on the slide-base members 42, 43, along the elongate platen 41, without being tilted relative to the platen 41. However, the ink-jet recording head 40 may be attached to the two slide-base members 42, 43, before the slide-base members 42, 43 are attached to the main frame 73.

Thus, in the present embodiment, when the MFD 10 is produced, in particular, when the image recording portion 24 is produced, the frame assembly 72 is assembled once so as to be judged with respect to the accuracy of assembling. Thus, when the MFD 10 is produced, a defective frame assembly or assemblies 72 can be discarded with reliability. That is, the MFD 10 can be produced under a high-grade quality control. After the accuracy of the frame assembly 72 is thus checked, the frame assembly 72 is disassembled and, in the state in which the two slide-base members 42, 43 are separate from the main frame 73, the elongate platen 41 is attached to the main frame 73. Then, the two slide-base members 42, 43 are positioned relative, and fixed, to the main frame 73, and the ink-jet recording head 40 is mounted on the slide-base members 42, 43. Therefore, the assembling of the MFD 10, in particular, the image recording portion 24 can be easily carried out, while the platen 41 and the recording head 40 are accurately assembled with the frame assembly 72.

In addition, in the present embodiment, the frame assembly 72 has the four recessed portions 90, 91, 92, 93 (FIG. 9) that cooperate with each other to bear the two feed rollers 55, 57. Therefore, after the accuracy of the frame assembly 72 is checked as described above, the two feed rollers 55, 57 are assembled with the main frame 73 in the state in which the two slide-base members 42, 43 are separate from the main frame 73. Thus, the two feed rollers 55, 57 can also be accurately attached to respective designed positions or portions of the main frame 73. Consequently the image recording portion 24 including the main frame 73, the platen 41, the slide-base members 42, 43, the ink-jet recording head 40, and the feed rollers 55, 57 can be assembled with improved accuracy.

In addition, the two slide-base members 42, 43 are supported by the four shoulder portions 76, 77, 83, 84 of the main frame 73, by being placed on the respective support surfaces 78, 79, 85, 86 of the shoulder portions 76, 77, 83, 84. Since the six projections 80, 81, 82, 87, 88, 89 projecting from the four support surfaces 78, 79, 85, 86 fit in the six through-holes 99, 105, 106, 100, 107, 108 of the two slide-base members 42, 43, respectively, the two slide-base members 42, 43 are accurately positioned relative to the main frame 73. Thus, the two positioning devices that respectively position the two slide-base members 42, 43 relative to the main frame 73 enjoy a simple arrangement, which leads to reducing the production cost of the frame assembly 72. The respective support surfaces 78, 79, 85, 86 of the shoulder portions 76, 77, 83, 84 cooperate with each other to define the horizontal plane as the reference plane, and the six projections 80, 81, 82, 87, 88, 89 of the main frame 73 and the six through-holes 99, 105, 106, 100, 107, 108 of the two slide-base members 42, 43 cooperate with each other to constitute two on-line positioning portions each of which positions a corresponding one of the two slide-base members 42, 43 relative to the main frame 73 in each of the two horizontal directions perpendicular to each other.

Moreover, the four spring members 109, 114 are attached to the frame assembly 72 in the state in which the two slide-base members 42, 43 are attached to the main frame 73. Thus, owing to the respective biasing forces caused by the respective elastic forces of the four spring members 109, 114, the two slide-base members 42, 43 are biased toward the main frame 73. The respective elastic forces of the four spring members 109, 114 can be easily converted into the respective biasing forces, by the eight inclined surfaces 117, 118, 123, 124 of the six projections 80, 81, 82, 87, 88, 89. Thus, the two elastically biasing devices that elastically bias the two slide-base members 42, 43 to the main frame 73, respectively, enjoy a simple arrangement, which leads to further reducing the production cost of the frame assembly 72 or the image recording portion 24. In addition, since each of the four spring members 109, 114 can move or displace along the corresponding two inclined surfaces 117, 118, 123, 124, the vibration of the frame assembly 72 can be absorbed by the spring members 109, 114, which leads to improving the quality of images recorded on each recording sheet.

In particular, in the present embodiment, the six projections 80, 81, 82, 87, 88, 89 that are used for positioning the two slide-base members 42, 43 are also used for holding the four spring members 109, 114. Thus, each of the two positioning devices and the two elastically biasing devices enjoy a still simpler arrangement.

Each of the four spring members 109, 114 is formed by bending or curving, on a plane, a metallic wire such as a spring-steel wire. Thus, each of the four biasing members 109, 114 that bias the two slide-base members 42, 43 toward the main frame 73 enjoys a simple arrangement and a low cost, which leads to reducing the production cost of the image recording portion 24. In addition, since each of the four metallic-wire-based spring members 109, 114 is attached to the frame assembly 72 so as to be extended parallel to the corresponding slide-base member 42, 43 and be pressed thereon, the vibration of the frame assembly 72 can be effectively absorbed, which leads to improving the quality of images recorded on each recording sheet.

In addition, each first spring member 109 as a portion of the first biasing device that biases the first slide-base member 42 toward the main frame 73 has the two symmetric leg portions 119, 120 that are moved or displaced in opposite directions, respectively, when the each first spring member 109 is elastically restored to its original shape after being elastically deformed. The two symmetric leg portions 119, 120 are held in pressed contact with the two symmetric inclined surfaces 117, 118 (FIG. 11), respectively. Thus, the elastic force applied by one 119 of the two leg portions 119, 120 to the corresponding inclined surface 117 is well balanced by the elastic force applied by the other leg portion 120 to the corresponding, other inclined surface 118. Therefore, each first spring member 109 is surely engaged, owing to the restoring elastic force thereof, with a corresponding one of the two projections 80, 87, and accordingly no special member for holding the each first spring member 109 is needed. Like each first spring member 109, each second spring member 114 as the second biasing device that biases the second slide-base member 43 toward the main frame 73 has the two symmetric leg portions 125, 126 that are moved or displaced in opposite directions, respectively, when the each second spring member 114 is elastically restored to its original shape after being elastically deformed. The two symmetric leg portions 125, 126 are held in pressed contact with the two symmetric inclined surfaces 123, 124 (FIG. 12), respectively. Thus, the elastic force applied by one 125 of the two leg portions 125, 126 to the corresponding inclined surface 123 is well balanced by the elastic force applied by the other leg portion 126 to the corresponding, other inclined surface 124. Therefore, each second spring member 114 is surely engaged, owing to the restoring elastic force thereof, with the corresponding two projections 81, 82, or 88, 89, and accordingly no special member for holding the each second spring member 114 is needed. Therefore, the frame assembly 72 enjoys a still simpler construction, and the image recording portion 24 can be produced at a still lower cost.

In the present embodiment, each of the four spring members 109, 114 has a symmetric shape. However, each spring member may have an asymmetric shape so long as two portions thereof that are engaged with the two inclined surfaces 117, 118, or 123, 124, respectively, are moved or displaced in opposite directions, respectively, when the each spring member is elastically restored to its original shape after being elastically deformed.

It is to be understood that the present invention may be embodied with various changes, modifications, and improvements that may occur to a person skilled in the art without departing from the spirit and scope of the invention defined in the appended claims.

What is claimed is:

1. An image recording apparatus, comprising:

a platen which is adapted to support a recording sheet that is fed in a sheet-feed direction;

a recording head which is movable along the platen, in a head-movement direction perpendicular to the sheet-feed direction, so as to record an image on the recording sheet;

a frame assembly including a main frame which supports the platen, and at least one slide-base member which is supported by an upper portion of the main frame and which supports the recording head such that the recording head is slideable on said at least one slide-base member along the platen;

at least one positioning device which positions said at least one slide-base member relative to the main frame in at least one horizontal direction and a downward direction, such that said at least one slide-base member is permitted to be displaced relative to the main frame in an upward direction; and at least one biasing device which includes at least one elastic member that produces an elastic force and is removable from the frame assembly, and which, in a state in which said at least one positioning device permits said at least one slide-base member to be displaced relative to the main frame in the upward direction, biases said at least one slide-base member toward the main frame by pressing, based on the elastic force produced by said at least one elastic member, an upper surface of said at least one slide-base member in at least the downward direction, wherein said at least one positioning device positions said at least one slide-base member relative to the main frame, such that in a state in which said at least one elastic member is removed from the frame assembly, said at least one slide-base member is permitted to be removed from the main frame in the upward direction.

2. The image recording apparatus according to claim 1, wherein said at least one positioning device positions said at least one slide-base member relative to the main frame, such that said at least one slide-base member is permitted to be removed from the main frame in the upward direction, without using a tool.

3. The image recording apparatus according to claim 1, wherein the frame assembly includes two said slide-base members which are supported by the upper portion of the main frame and which cooperate with each other to support the recording head, wherein the apparatus comprises two said biasing devices each of which comprises said at least one elastic member which biases a corresponding one of the two slide-base members toward the main frame in at least the downward direction, and wherein the apparatus comprises two said positioning devices each of which positions a corresponding one of the two slide-base members relative to the main frame, such that in a state in which said at least one elastic member of a corresponding one of the two biasing devices is removed from the frame assembly, said one slide-base member is permitted to be removed from the main frame in the upward direction.

4. The image recording apparatus according to claim 1, wherein the recording head comprises an ink jet recording head which ejects a droplet of ink toward the recording sheet and thereby records the image thereon.

5. The image recording apparatus according to claim 1, further comprising at least one feed roller which feeds the recording sheet relative to the platen in the sheet-feed direction, wherein the main frame has at least two bearing portions which cooperate with each other to bear said at least one feed roller such that said at least one feed roller is rotatable about an axis line thereof parallel to the head-movement direction.

6. The image recording apparatus according to claim 1, wherein said at least one positioning device comprises:

at least one support portion which is provided by the upper portion of the main frame and which has at least one support surface which supports said at least one slide-base member;

at least one projection which projects from one of (A) the main frame and (B) said at least one slide-base member toward an other of (A) the main frame and (B) said at least one slide-base member; and at least one recess which is formed in said other of (A) the main frame and (B) said at least one slide-base member and in which said at least one projection fits such that said at least one slide-base member is held in close contact with said at least one support surface of the main frame.

7. The image recording apparatus according to claim 6, wherein said at least one projection projects from said at least one support surface of the main frame.

8. The image recording apparatus according to claim 6, wherein said at least one biasing device comprises:

at least one elastic-member holding portion which is provided by said one of (A) the main frame and (B) said at least one slide-base member and which has at least one inclined surface which is inclined by an acute angle relative to a plane parallel to the sheet-feed direction and the head-movement direction;

said at least one elastic member which is elastically deformable on said plane; and at least one first through-hole which is formed through a thickness of said other of (A) the main frame and (B) said at least one slide-base member and in which said at least one elastic-member holding portion fits from one of opposite surfaces of said other of (A) the main frame and (B) said at least one slide-base member, so that said at least one elastic-member holding portion projects from an other of the opposite surfaces and said at least one elastic member being elastically deformed on said plane engages said at least one inclined surface such that said at least one elastic member is displaceable along said at least one inclined surface, and wherein said at least one elastic-member holding portion is provided by said at least one projection, and said at least one inclined surface is provided by a surface of said at least one projection.

9. The image recording apparatus according to claim 8, wherein said at least one projection has at least one second through-hole, and at least one inner surface defining said at least second one through-hole, and wherein said at least one inclined surface is provided by at least a portion of said at least one inner surface.

10. The image recording apparatus according to claim 8, wherein said at least one positioning device comprises two said projections and two said recesses in which the two projections fit, respectively, wherein said at least one biasing device comprises two said elastic-member holding portions and two said first trough-holes in which the two elastic-member holding portions fit, respectively, and wherein the two elastic-member holding portions are provided by the two projections, respectively, and said at least one inclined surface of each of the two elastic-member holding portions is provided by at least one outer surface of a corresponding one of the two projections.

11. The image recording apparatus according to claim 1, wherein said at least one biasing device comprises:

at least one elastic-member holding portion which is provided by one of (A) the main frame and (B) said at least one slide-base member and which has at least one inclined surface which is inclined by an acute angle relative to a plane parallel to the sheet-feed direction and the head-movement direction;

said at least one elastic member which is elastically deformable on said plane; and at least one through-hole which is formed through a thickness of an other of (A) the main frame and (B) said at least one slide-base member and in which said at least one elastic-member holding portion fits from one of opposite surfaces of said other of (A) the main frame and (B) said at least one slide-base member, so that said at least one elastic-member holding portion projects from an other of the opposite surfaces and said at least one elastic member being elastically deformed on said plane engages said at least one inclined surface such that said at least one elastic member is displaceable along said at least one inclined surface.

12. The image recording apparatus according to claim 11, wherein said at least one elastic-member holding portion has a pair of said inclined surfaces which are symmetric with each other with respect to a second plane perpendicular to a first plane as said plane, and wherein said at least one elastic member includes a pair of engaging portions which engage the pair of inclined surfaces, respectively, and which are displaced along the pair of inclined surfaces, in opposite directions, respectively, when said at least one elastic member is elastically restored toward an original shape thereof after being elastically deformed on the first plane.

13. The image recording apparatus according to claim 10, wherein said at least one elastic member is formed by bending or curving a metallic wire on said plane.

14. The image recording apparatus according to claim 1, wherein said at least one slide-base member comprises at least one plate-like member having opposite surfaces a lower one of which is supported by the upper portion of the main frame and the other, and an upper one of which supports the recording head such that the recording head is slideable thereon along the platen.

15. The image recording apparatus according to claim 1, wherein said at least one positioning device comprises:

at least one support surface which is provided by one of (A) the main frame and (B) said at least one slide-base member; and at least one projection which projects from said at least one support surface of said one of (A) the main frame and (B) said at least one slide-base member toward an other of (A) the main frame and (B) said at least one slide-base member, and wherein said at least one biasing device is provided between said at least one projection and said other of (A) the main frame and (B) said at least one slide-base member and biases said at least one slide-base member toward the main frame in at least the downward direction such that said at least one support surface is held in close contact with said other of (A) the main frame and (B) said at least one slide-base member.

16. The image recording apparatus according to claim 1, wherein said at least one positioning device comprises:

at least one support surface which is provided by one of (A) the main frame and (B) said at least one slide-base member;

at least one projection which projects from said at least one support surface of said one of (A) the main frame and (B) said at least one slide-base member toward an other of (A) the main frame and (B) said at least one slide-base member; and at least one recess which is formed in said other of (A) the main frame and (B) said at least one slide-base member and in which said at least one projection fits, and wherein said at least one biasing device biases said at least one slide-base member toward the main frame in at least the downward direction such that said at least one support surface is held in close contact with said other of (A) the main frame and (B) said at least one slide-base member.

17. The image recording apparatus according to claim 1, wherein said at least one elastic member extends parallel to the upper surface of said at least one slide-base member.

* * * * *